US005402809A

United States Patent [19]

Smith

[11] Patent Number: 5,402,809

[45] Date of Patent: Apr. 4, 1995

[54] APPARATUS FOR CLEANING INDUSTRIAL SAFETY APPAREL

[76] Inventor: Jeffrey P. Smith, 128 Oakes Dr., Columbus, Ohio 43207

[21] Appl. No.: 179,907

[22] Filed: Jan. 11, 1994

[51] Int. Cl.[6] ..... B08B 3/02

[52] U.S. Cl. ..... 134/129; 134/144; 134/155; 134/158

[58] Field of Search ..... 134/70, 95.3, 126, 129, 134/131, 144, 148, 153, 155, 158; 422/300; 68/205 R

[56] References Cited

U.S. PATENT DOCUMENTS 3,131,840 5/1964 Berger et al. ..... 68/205 R X

*Primary Examiner*—Philip R. Coe

*Attorney, Agent, or Firm*—Mueller and Smith

[57] ABSTRACT

Apparatus is provided for cleaning industrial apparel such as wire mesh safety gloves used in processing meats such as chickens. The apparatus employs a containment chamber within which a conveyor carries the gloves which are mounted upon substantially elevated glove mounts. Within the chamber, high pressure nozzles are rotated to express hot chlorinated water upon the gloves over a residence interval of about one minute. The apparatus employs parallel inputs of hot and cold water, the latter being chlorinated within a range of about 150 to 200 ppm. Cleanability is enhanced through the utilization of facilely removed light weight flat front and side doors and a pivoting forward deck assembly. Bacteria-promoting pockets and the like are minimized through the utilization of sanitary welds and O-ring mounted polymeric bearing blocks.

14 Claims, 16 Drawing Sheets

APPARATUS FOR CLEANING INDUSTRIAL SAFETY APPAREL

BACKGROUND OF THE INVENTION

Poultry, beef, and fish processing is an extensive industry. Every year, for example, approximately four billion chickens are processed and sold in the United States alone. Unfortunately, mass production techniques make processing plants prime breeding grounds for food poisoning bacteria such as Salmonella and Escherichia. "According to the federal Food Safety & Inspection Service in Washington, D.C., about 37 percent of all chicken meat sold in the United States is infected with Salmonella. The Center for Disease Control in Atlanta estimates that Salmonella, which can cause severe stomach pains and even typhoid fever, kills about 1,000 people a year and causes another 35,000 to be hospitalized." "Microbiologist hatches test kit for salmonella", *San Francisco Business Times*, (Jul. 6, 1987) p. 13.

In the poultry industry, chickens are shipped to a processing plant where they are killed, defeathered, and eviscerated along rapidly moving disassembly lines. Assembly line workers commonly wear protective steal mesh gloves to guard against accidental injuries from knives which are used during product cut-up and evisceration. During processing, bacteria and other contaminants associated with the chickens inevitably are transmitted to these gloves. As a result, the U.S.D.A. has developed information concerning bacteria concentration levels for safe, sanitary assembly line operations. These bacteria levels are measured according to a bacteria plate count which signifies the number of bacterial colonies per square inch. It is currently understood that a bacteria plate count of one hunted or less is considered sterile and thus acceptable. The food processing industry has been attempting to develop an effective approach to mitigate bacterial dissemination and clean soiled gloves in a manner commensurate with such governmental standards.

In multi-shift plants, gloves typically are cleaned at the end of a given shift for subsequent use. If adequate cleaning has not occurred, process workers may start a shift with gloves that already have an unacceptable plate count. Thereafter, during the shift, every chicken, from the first one handled, may be infected with bacteria. As an example of the potential for bacterial dissemination, larger processing plants may run assembly lines at ninety chickens per minute with a chain of processing personnel, one person handling every third bird. By the end of a shift, a single processor may come in contact with hundreds of birds and have a glove contamination at a plate count level of half a million or more. Moreover, each bird may be handled by as many as ten different processors. As a result, cross contamination of bacteria among chickens inevitably occurs. The resultant need for clean gloves during processing is apparent.

In the poultry industry, there presently is no uniformly practiced method for adequately cleaning gloves to meet the governmental requirements. One method for cleaning is to use high pressure water from a spray wand. The gloves are placed on the plant floor, frequently already contaminated, secured under a foot, and manually sprayed with high pressure water to remove flesh and other particles. This method has proven less than effective in that spraying with high pressure water alone merely removes larger, visible contaminants. Micro-analysis testing reveals that the gloves still have a high bacteria plate count concentration, often in the hundred thousand range. If the gloves are used after spraying, the bacteria not washed out will continue to multiply exponentially with time, contaminating the production system. The wand cleaning method is additionally inefficient in that it requires several minutes to spray and clean each glove, which must be done one at a time. Preferably, glove cleaning should be carded out during a given shift, for example, during breaks as well as following it. Unfortunately, those breaks are of such a short duration as to preclude such desirable practices. Additionally, the number of gloves involved is substantial; larger plants employ four to five hundred gloves used in a single shift. Another cleaning approach involves soaking the gloves in a chemical sanitizing solution. This process, however, typically requires overnight treatment which makes it impractical for use with multi-shift plants requiring rapid cleaning, as for example during a five minute break or between shifts.

In another approach, a washer has been employed which operates much like a conventional, household dishwasher. Contaminated gloves are placed upright on open ended forks which slowly cycle through a washing chamber. Inside the chamber, the gloves are blasted by high pressure cold water jets. Designs heretofore offered to industry have been found to be unacceptable because of the difficulties of cleaning the machines themselves, the entanglement of the gloves within conveyor assemblies, limited plant water supplies, cross contamination of gloves during the cleaning process, unacceptable plate count levels, and the like.

Other washers combine soap and hot water cleaning cycles. These devices require a separate rinsing chamber and washing chamber which greatly adds to manufacturing and maintenance costs. Still other devices have used anhydrous ammonia as a sterilizing agent (400 ppm) which have experienced severe waste disposal problems.

Effective cleaning necessarily involves cleaning the glove tips. During processing, the finger tips are in frequent pressure contact with chicken parts and, as a result, are heavily contaminated with flesh and the like. A washer should be designed to remove the contaminants in these concentrated areas to produce a glove with a safe bacterial level.

An effective washer should not only lower plate count levels, but also be designed for effective periodic cleaning. In this regard, bacteria removed from the gloves during washing tends to accumulate and grow in the washing chamber. Crevices, nooks, protrusions, and any other non uniform surface act as pockets where bacteria may grow. As the gloves are being cleaned in the washing chamber, they are often exposed to contamination from such bacteria pockets, for example through splashing. Cross contamination between dirty gloves entering the chamber and clean ones leaving may also occur. As another design consideration, washers are periodically cleaned to remove bacteria, such as that accumulating in the pockets. Prior washers, have not been adequately designed for easy disassembly. Typically, extensive time and effort is required to access interior locations for cleaning or maintenance.

SUMMARY

Figure 1:
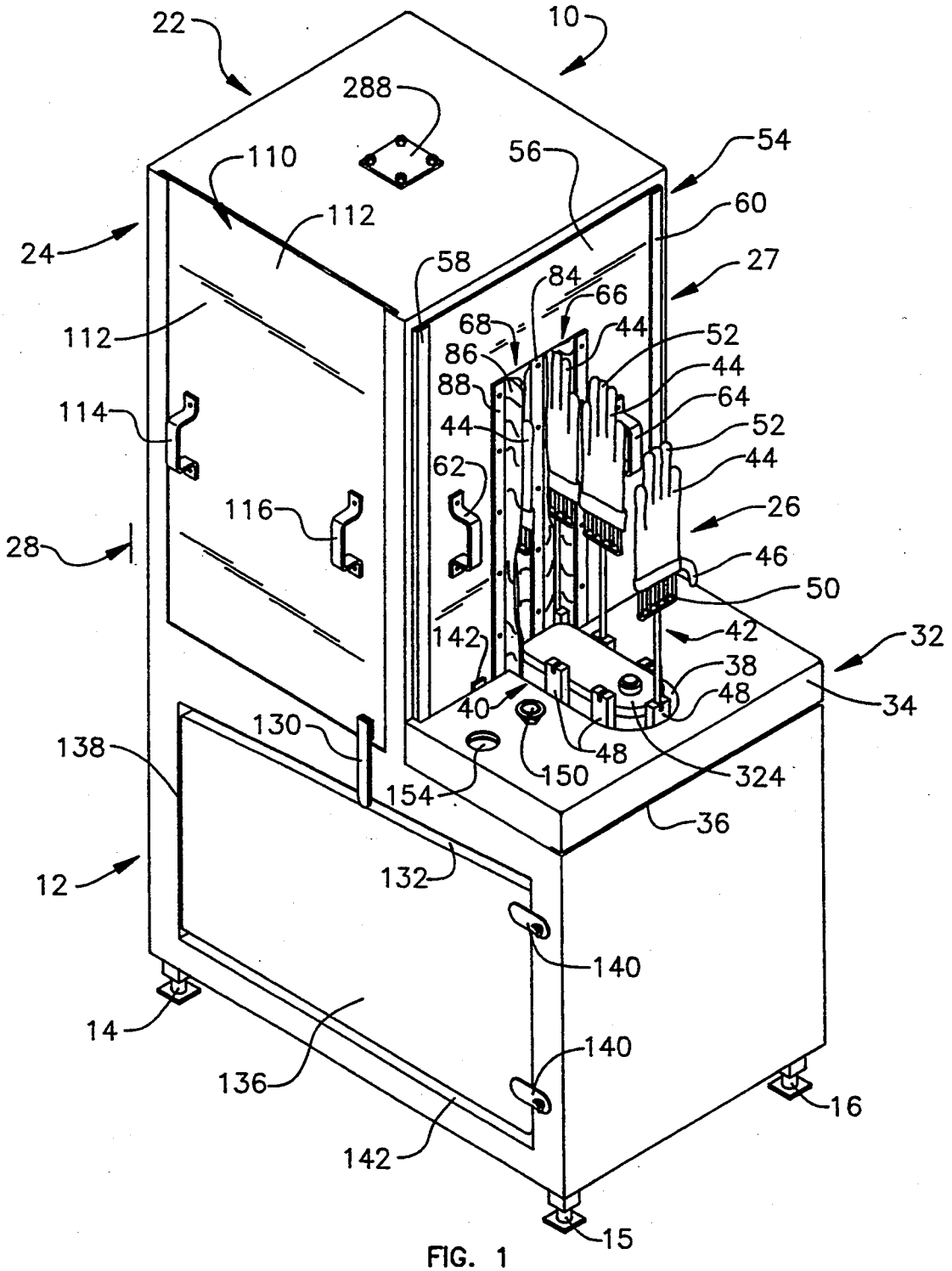
FIG. 1 is a perspective view of apparatus configured according to the invention.

The present invention is addressed to apparatus for cleaning industrial safety apparel such as wire mesh gloves with efficiency and speed. Gloves employed in processing meat products such as chickens are cleaned effectively within a time interval permitting more frequent cleaning, for example, during short work breaks in the course of a given shift and with an apparatus which is fabricable at practical cost levels.

Cleaning is carried out within a confined chamber into which a conveyor assembly extends carrying gloves upon uniquely elevated glove mounts. Movement of the glove mounts is along a conveyor locus of movement extending from an access deck assembly. The height of the glove mounts is effective to avoid glove entanglement with moving components of the apparatus. To achieve ingress and egress from the containment chamber with the elevated glove mounts, a unique curtain assemblage formed of very thin plastic and with varying side-to-side overlapping is employed. In this regard, a very small overlap is employed at the level of the gloves themselves where high pressure nozzle outputs are not present. Correspondingly, a greater overlap of entrance and exit curtains is employed below the level of the glove where potentials for spray excursions are present. While within the cleaning chamber for a relatively short residence interval, the gloves are subjected to high pressure spraying of chlorinated water expressed from rotating nozzles at an elevated temperature of about 100° F. Such elevated temperature evokes a flesh cooking activity facilitating its removal, while chlorination in amounts within a range of about 150 to 200 pans per million (ppm) facilitates flesh removal while destroying bacteria. Cross contamination of clean gloves from dirty gloves is avoided through a ramp developed enhancement of removal of contaminated cleaning fluid from the chamber and with a unique exit and entrance separation structuring. To facilitate the removal of contaminant from the tips of gloves, the axis of rotation of the cleaning nozzles is offset slightly from the axis of rotation of the locus of movement of the glove mounts within the chamber. This evokes an undulation or relative movement between the nozzles dedicated to glove tip cleaning and the tips of the gloves themselves. The utilization of hot water along with cold water from the water supply of a given processing plant assures an adequate water supply to the instant apparatus for application within plants with relatively limited water availability.

The important aspect of cleaning the apparatus, for example during cleaning shifts, is enhanced through the utilization, for example, of removable doors or panels from two sides of the containment chamber. This exposes the interior regions of the cleaning chamber for facile access by cleaning personnel. To remove these light weight doors or panels, such cleaning personnel need only lift them a few inches and slide them sideways. Reinstallation of the doors is carried out simply following the reverse procedure. Access further is achieved through a pivoting front deck assembly, not requiring deck lid removal to simplify a pivoted repositioning. Cleaning further is enhanced through the employment of the noted sloping ramp beneath the conveyor assembly which extends under front access deck components. This ramp assembly supports a number of components including bearing blocks for rotating shafts. These bearing blocks are formed of a plastic material immune to chemical attack and which incorporate an O-ring attachment with the ramp surface to minimize the amount of potential contaminant cavity regions.

Other objects of the invention will, in part, be obvious and will, in part, appear hereinafter.

The invention, accordingly, comprises the system and apparatus possessing the construction, combination of elements, and arrangement of parts which are exemplified in the following disclosure.

For a fuller understanding of the nature and objects of the invention, reference should be had to the following detailed description taken in conjunction with the accompanying drawings.

DETAILED DESCRIPTION OF THE INVENTION

The apparatus of the present invention functions to carry out the cleaning of industrial gloves and the like to an extent wherein contaminant removal and associated bacterial removal achieves about a 99% reduction in the plate count levels for each machine pass or cycle. This is accomplished without cross-contamination between emerging clean and entering contaminated gloves and within a cleaning cycle of duration which permits the gloves of a typical production shift to be cleaned during an employee break in the course of a given production shift. Of corresponding importance, the apparatus is accessible for cleaning by cleaning personnel during a cleaning shift or time interval following normal production shifts. It is during these intervals of time that the cleaning personnel must have facile access to all aspects of the machine regions to be cleaned such that cleaning can be carried out effectively without leaving bacterial pockets and the like. In this respect, pockets or bolted connections and the like which may create bacterial collecting regions are avoided and the system almost achieves a "self-cleaning" aspect in the normal course of its operation. Additionally, access to the regions of the apparatus to be cleaned is substantially improved along with a lessening of the physical requirements for achieving such access. These features are achieved utilizing the typically limited water supplies available in a production environment and at cost levels which are practical.

Referring to FIG. 1, a pictorial representation of the apparatus for removing flesh containing contaminants from protective gloves is shown generally at 10. The apparatus 10 includes a lower support assembly 12 intended to be placed upon a plant floor surface. For this purpose, leveling feet, three of which are shown at 14–16, are provided to assure proper leveling to achieve optimum fluid flow. The fourth of such leveling feet is shown at 17 in FIG. 4. Lower support assembly 12, in turn, supports a containment chamber represented generally at 22 which is depicted having an upper portion represented generally at 24, a lower portion shown generally at 26, a forward portion 27 and two side portions, one of which is seen in general at 28 in the present figure, the opposite side of which is seen at 30 in FIGS. 3–5. Additionally supported upon the lower support assembly 12 and adjacent the containment chamber 22 forward portion 27 is an access deck assembly represented generally at 32. Deck assembly 32 includes a deck cover 34 which is hinged to the lower support assembly 12 at hinge 36. Centrally within the assembly 32 there is formed an opening 38 having a U-shaped periphery which functions to access the entrance region of a conveyor assembly represented generally at 40.

Conveyor assembly 40 serves to support a sequence of stainless steel glove mounts represented generally at 42. Gloves as at 44 are drawn over the mounts 42 which, inturn, are positioned for movement by the conveyor assembly 40 into containment chamber 22, whereupon the gloves undergo high pressure spray cleaning. Certain of the gloves 44 are seen to have a wrist securement strap or component 46 which will tend to hang downwardly as the gloves are moved along a conveyor locus defined by the conveyor assembly 40. Each of the glove mounts 42 is formed having a rod support component 48 into which a relatively high, fork-shaped glove support 50 is removably inserted. Such a fork-shaped glove support 50 is seen without a mounted glove 44 in FIG. 2. Glove supports 50 are removed by personnel for the purpose of inserting them within a glove 44, whereupon they are reinstalled within the rod support components 48 as the personnel stand before the access deck assembly 32. Generally, the glove mounts 42 are configured such that the tip regions 52 of gloves 44 are about 25 inches above the conveyor assembly. This relatively elevated configuration assures that no entanglement occurs between such components as the straps 46 and the conveyor assembly 40. However, accommodation is required for the greater bending moments imposed upon the glove mounts 42 occasioned during the entrance to and exit from containment chamber 22.

Considering the entrance of the sequence of glove 44 carrying glove mounts 42 into the containment chamber 22, it may be observed that the forward portion 27 of chamber 22 is configured having a flat forward door assembly represented generally at 54 and comprised of a flat transparent polymeric front door 56 which is slidably received within two spaced-apart, vertically disposed channel-defining forward door tracks 58 and 60. Slidable movement of the front door 56 is facilitated by two stainless steel, D-shaped handles 62 and 64.

Figure 3:
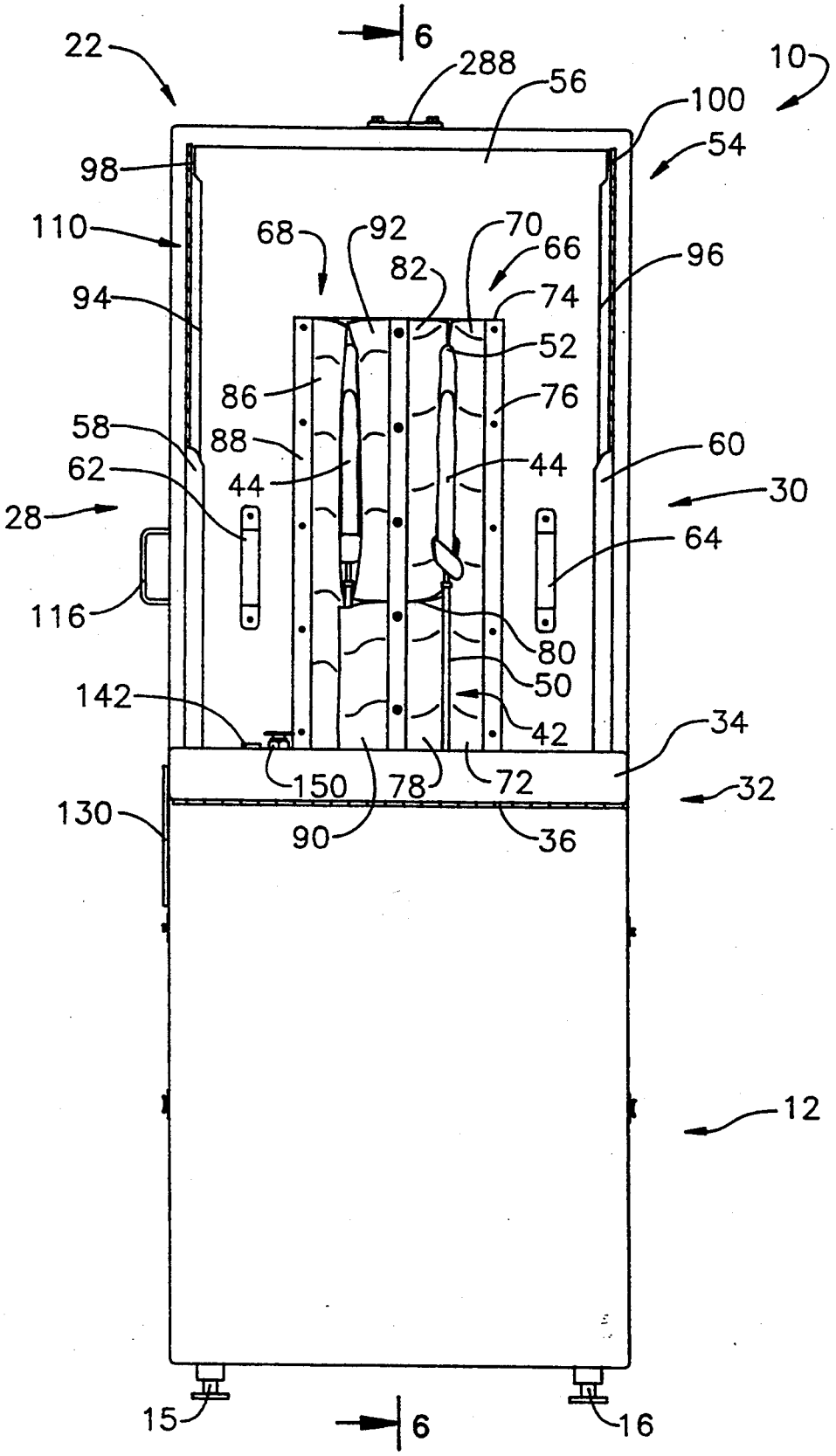
FIG. 3 is a front view of the apparatus of FIG. 1.

Looking additionally to FIG. 3, it may be observed that the central portion of front door 56 is configured to accommodate an entrance curtain assembly represented generally at 66 and an oppositely disposed exit curtain assembly represented generally at 68. Curtain assemblies 66 and 68 are designed for the purpose of protecting the user of apparatus 10 from the high pressure sprays and contaminant carrying fluid splashes extant within containment chamber 22. They also are designed to accommodate for the earlier-noted relatively elevated stature of the glove mounts 42 and the bending moments associated with their movement into and out of chamber 22. This is achieved through the utilization of a very thin, flexible polymeric material, for example polyurethane, having a thickness of about 0.060 inch in combination with a selective curtain overlap arrangement. In this regard, entrance curtain assembly 66 includes an inwardly facing vertically oriented flexible polymeric sheet 70 having a length extending from a bottom location 72 (FIG. 3) adjacent conveyor assembly 40 to an upper location 74 positioned slightly above the tip region 52 of a glove 44 when mounted upon glove mount 42. Polymeric sheet 70 is attached to the forward face of front door 56 by a stainless steel strap 76.

The opposite side of entrance curtain assembly 66 is configured having two flexible polymeric sheets which selectively overlap polymeric sheet 70. In this regard, the lower one of these polymeric sheets 78 extends from bottom location 72 to a top location or elevation 80 adjacent to and spaced below a glove 44 when supported upon a glove mount 42. Lower polymeric sheet 78 overlaps the corresponding lower portion of polymeric sheet 70 by an amount effective to protect the user from the high pressure sprays extant within containment chamber 22. Generally, for the thin polymeric material involved, an overlap of about 1 inch is desirable. This 1 inch overlap also may be flexed rearwardly by the upstanding rod portion 368 of fork-shaped glove support 50. Extending above lower polymeric sheet 78 from top location 80 to upper location 74 is an upper polymeric sheet 82 of the same thickness but dimensioned to overlap the corresponding upper portion of polymeric sheet 70 by a much smaller amount, for example, less than about $\frac{3}{8}$ inch and preferably about $\frac{1}{4}$ inch. This lesser overlap facilitates the flexing of the curtain components by the glove and glove mount assembly as it is pushed therethrough by the conveyor assembly 40. Attachment of both lower polymeric sheet 78 and upper polymeric sheet 82 is by a stainless steel strap 84 which is attached, in turn, to an inwardly disposed separation structure 292 (FIG. 6) of chamber 22. The lesser overlap provided by polymeric sheet 82 becomes available inasmuch as high pressure fluids are not directed toward it and, thus, it is required to contain only indirectly impinging fluids flashing from glove mounts 42 and associated gloves 44.

Exit curtain assembly 68 is similarly structured having an inwardly facing flexible polymeric sheet 86 which extends from bottom location 72 to upper location 74 and which is attached to front door 56 by a stainless steel strap 88. Polymeric sheet 86 is of the same thickness as sheet 70 and cooperates with a lower polymeric sheet 90 which is integrally formed with sheet 78 and attached to a shield structure 292 within chamber 22 by strap 84. As before, a one-inch overlap is provided by the sheet 90 for the purpose of accommodating higher pressure sprays and which is engaged by the lower portion of glove mounts 42 as they exit from containment chamber 22. Above polymeric sheet 90 there is positioned an upper polymeric sheet 92 dimensioned identically and formed integrally with corresponding polymeric sheet 82 and extending from the earlier-noted top location or elevation 80 to upper location 74. As before, the overlap provided by upper polymeric sheet 92 is less than about ⅜ inch and preferably about ¼ inch to permit facile egress of glove retaining glove mounts while confining splashing fluids to the entrance of chamber 22. Sheet 92 is fixed with sheet 82 to internal chamber structure by strap 84.

To facilitate the cleaning of chamber 22 during cleaning shift operations, the front door assembly 54 is configured to be removed with minimum physical effort. Initially, the front door 56 is formed of a lighter polymeric material, for example lexan having a thickness of about ¼ inch. FIG. 3 reveals that the door 56 has a generally T-shaped side edge configuration with lower side edges 94 and 96 being laterally spaced apart so as to be received within mutually inwardly facing channel-like openings of respective tracks 58 and 60.

Lower side edges 94 and 96 extend to respective upper side edges 98 and 100 which are spaced apart a greater distance. In this regard, the edges 98 and 100 fit snugly within the channels of tracks 58 and 60 such that slidable movement of them within the tracks is vertical and not horizontal. Correspondingly, the slidable movement of edges 94 and 96 within respective tracks 58 and 60 is both vertical and horizontal. With this arrangement, only a minimum of effort is required on the part of cleaning personnel to remove the front door 56. This is carried out by lifting it slightly to slide it upwardly within tracks 58 and 60 to an extent represented by the corresponding vertical extent of upper side edges 98 and 100. Door 56 then may be slid laterally in either direction an amount sufficient to clear tracks 58 and 60. With the arrangement, only a limited amount of lifting is called upon on the part of cleaning personnel to effect door removal and reinsertion.

Figure 2:
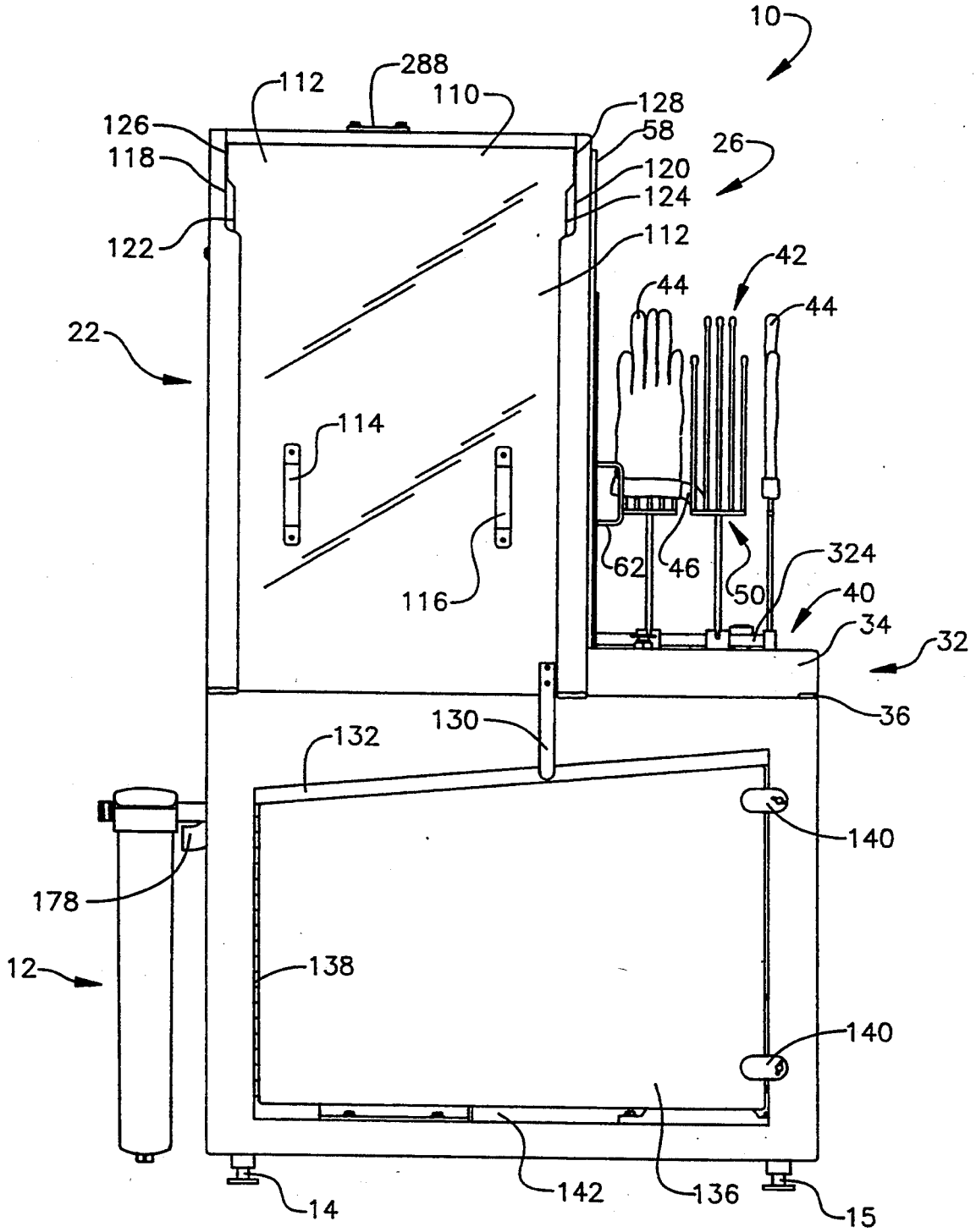
FIG. 2 is a left side view of the apparatus of FIG. 1.

The effective cleaning of chamber 22 also requires a high degree of access thereto that all pockets which possibly could contain bacteria promoting contaminants can be cleaned. To accommodate for this need, apparatus 10 incorporates a side door assembly which is represented in general in FIGS. 1 and 2 at 110. Side door assembly 110 is formed in similar fashion as front door assembly 54. In this regard, the assembly 110 includes a flat side door 112 formed of polymeric material such as lexan having a thickness of about ¼ inch. Attached to the lower portion of door 112 are two D-shaped stainless steel handles 114 and 116. Looking additionally to FIG. 8, door 112 is slidably received within internally disposed channel shaped tracks 118 and 120. FIG. 2 reveals that the side door 112 is configured having a generally T-shaped side edge configuration having laterally spaced-apart lower side edges 122 and 124 which are both horizontally and vertically slidable within respective tracks 118 and 120. Edges 122 and 124 transition to respective upper side edges 126 and 128 which are of limited vertical extent and are spaced apart a widthwise distance essentially restricting any lateral slidable movement of door 110. Thus, to remove or insert door 110, the cleaning personnel need only lift it the short distance represented by the lengthwise extents of edges 126 and 128, and slide it laterally in or out of the tracks 118 and 120. As before, no excessive physical effort is required for this procedure.

Figure 5:
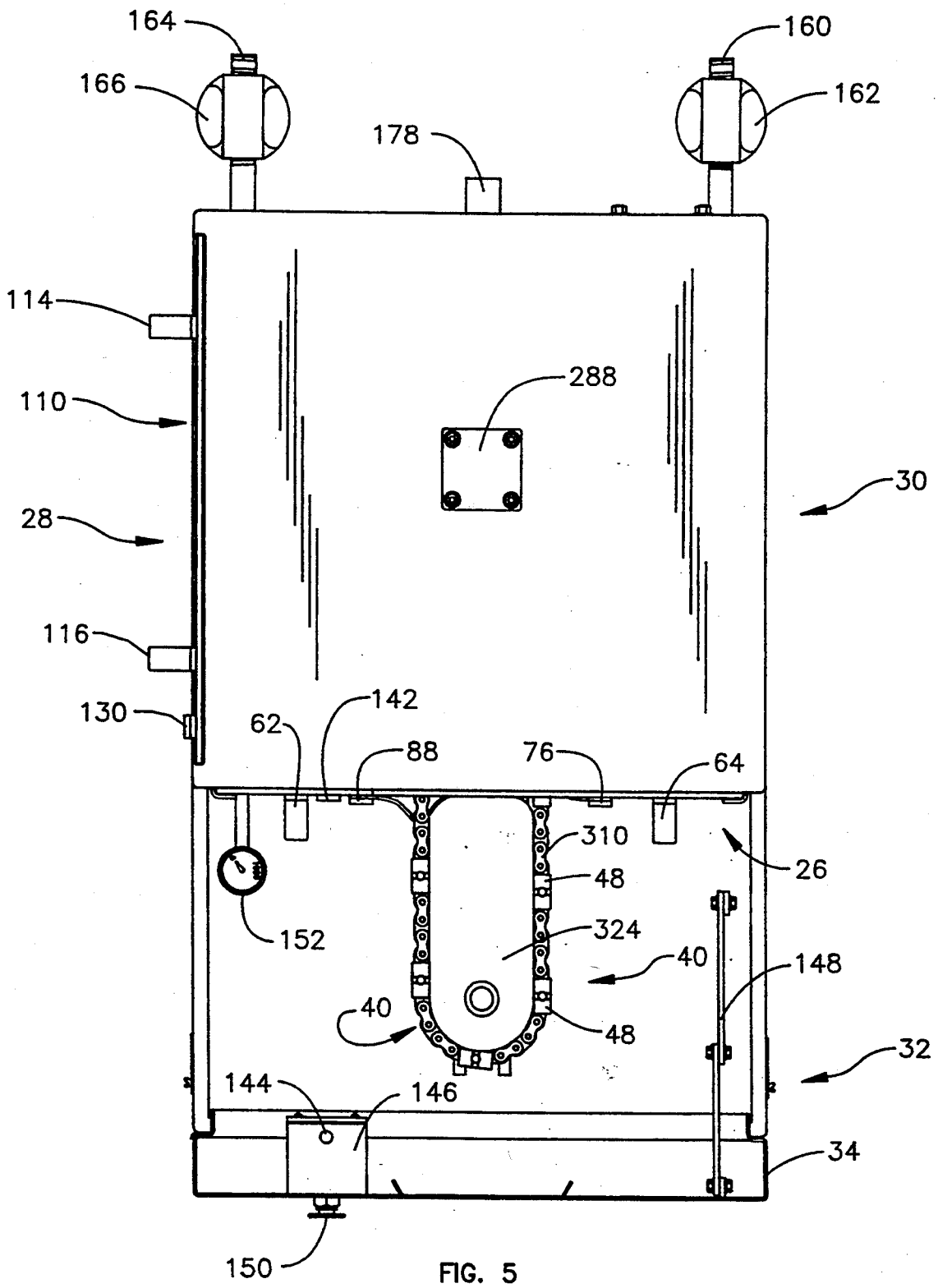
FIG. 5 is a top view of the apparatus of FIG. 1.
Figure 11:
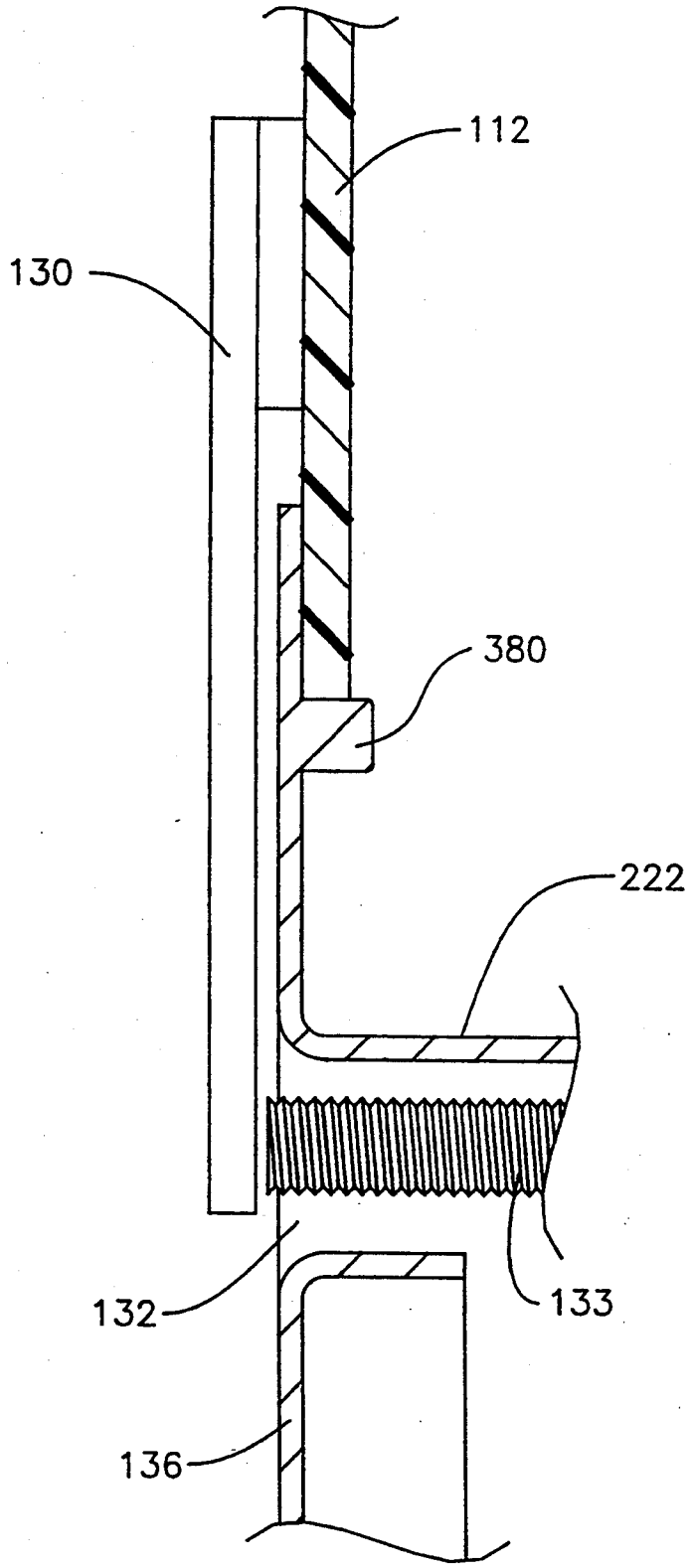
FIG. 11 is a partial sectional view taken through the plane 11—11 shown in FIG. 9.

FIGS. 1 and 11 also reveal the presence of a downwardly depending position locator component 130 which is attached to the door 110. This device extends downwardly such that its tip is positioned at a gap 132 within the lower support assembly 12 above an access door 136. Component 130 functions to close or otherwise actuate a proximity switch by its adjacency with switch component 133 (FIG. 11) located just behind gap 132. Door 136 is seen to be hinged at 138 and is latched at latches 140. Note the presence of a lower gap 142 beneath door 136. The proximity switch arrangement assures that high pressure nozzles within chamber 22 cannot be activated until door 112 is in a fully enclosing orientation. In similar fashion, a position locator component 142 is fixed to the lower region of front door 56. As seen in FIG. 5, locator component 142 cooperates with a proximity switch 144 which extends rearwardly from a circuit enclosure 146 attached, in turn, to the bottom of deck cover 34. Deck cover 34 is shown in FIG. 5 in an open, vertical orientation, being contained therein by a conventional elbow latching mechanism 148. With the arrangement shown, when the deck 34 is closed, the proximity switch 144 is adjacent the locator component 142 and assumes a closed or circuit completing orientation. Thus, the front door 56, side door 112, as well as deck cover 34 must be closed in order for the apparatus 10 to be enabled for operation. FIG. 5 also reveals the presence of a start/stop switch 150 associated with the circuit enclosure 146 as well as a pressure gauge 152 which may be viewed through an opening 154 within deck cover 34 as seen in FIG. 1.

Figure 4:
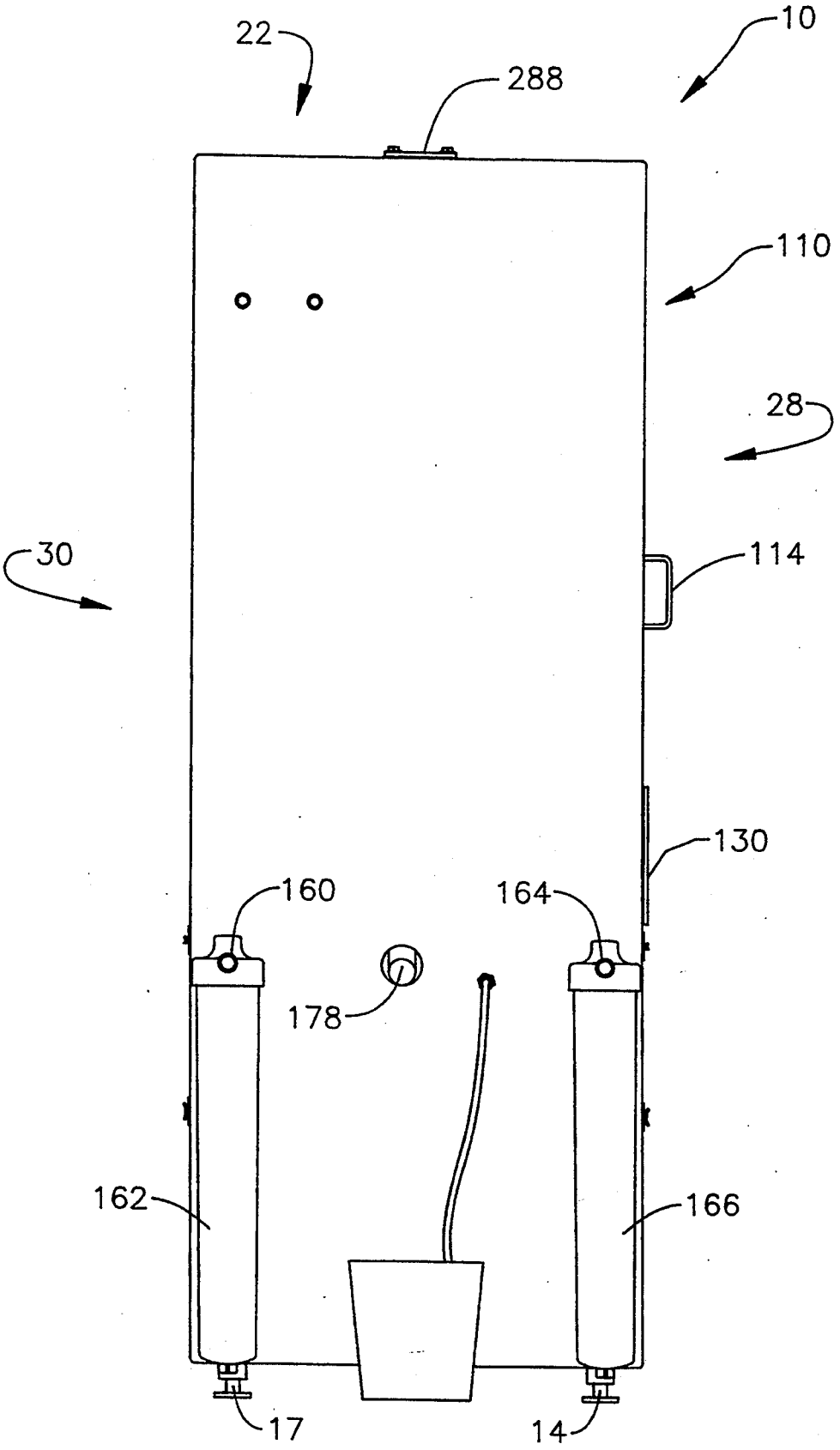
FIG. 4 is a rear view of the apparatus of FIG. 1.
Figure 6:
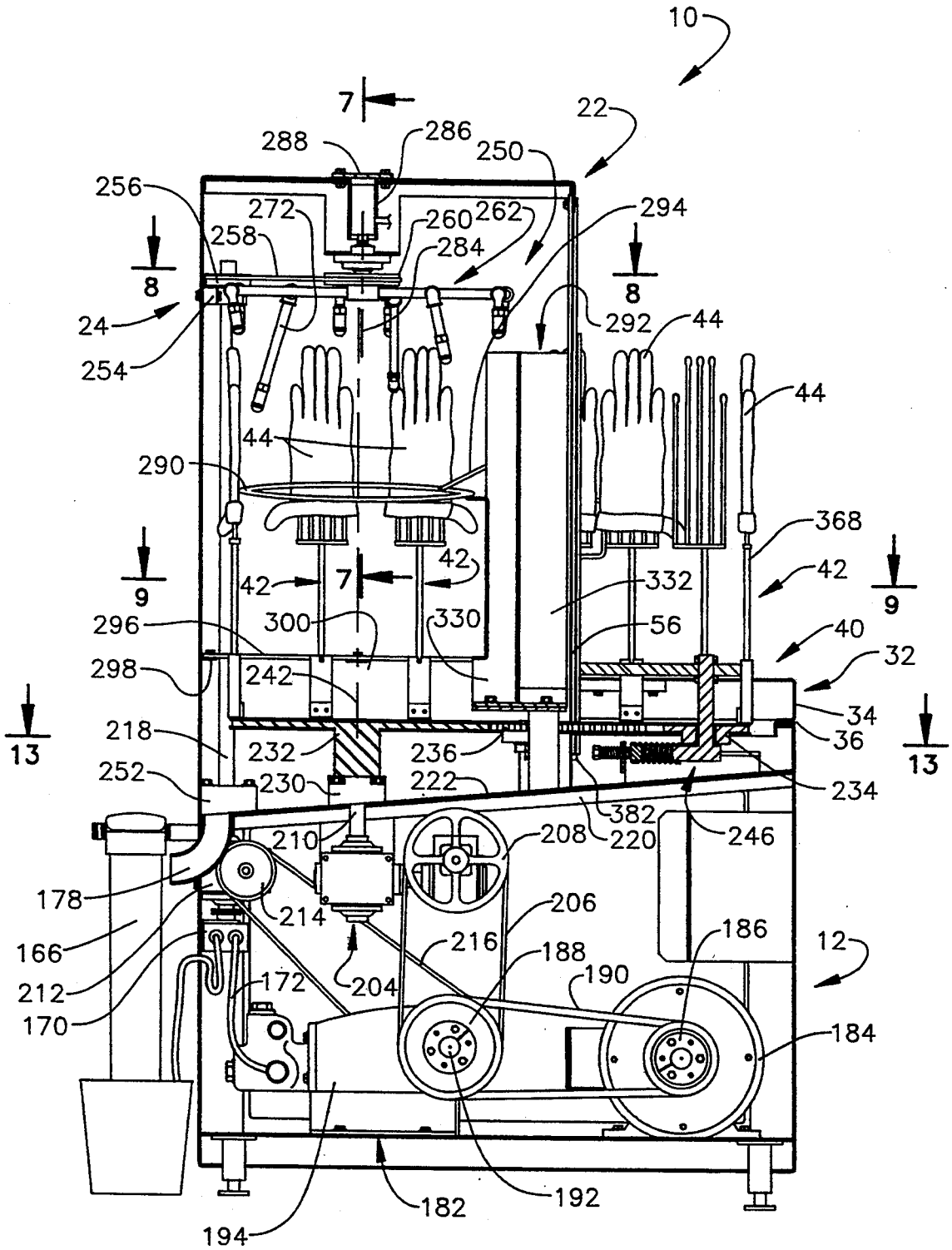
FIG. 6 is a sectional view of apparatus according to the invention taken through the plane 6—6 shown in FIG. 3.

Looking to FIGS. 2, 4, and 5, the water input components associated with apparatus 10 are revealed. In this regard, apparatus 10 utilizes two plant water inputs, one from the cold water supply, and the other from the plant hot water supply. This parallel input serves to make more efficient utilization of the typically limited water supplies of a processing plant and advantageously permits the utilization of heated water while permitting chlorine addition at the unheated water input. With the arrangement, water may be ejected from the cleaning nozzles at an optimum temperature of about 100° F. which substantially improves flesh removal. Additionally, the acidic nature of the chlorinated cleaning fluid functions to enhance bacteria removal as well as flesh contaminants. FIG. 4 reveals the dual water input. In this regard, heated water is introduced at inlet 160 to a filter 162, the output of which is directed to the interior of apparatus 10. Unheated water is introduced at inlet 164 of filter 166. The output of filter 166 at conduit 168 is introduced to a chlorinator 170. Chlorinator 170 may be provided as a metering pump, for example a series 410-1 metering pump marketed by TAT Engineering Corporation of Branford, Conn. The output of chlorinator 170 is directed to the interior of apparatus 110 via conduit 172. FIG. 6 additionally shows a waste fluid output port 178 which functions to convey contaminant containing fluids from the chamber 22.

Looking to FIG. 6, the internal components of apparatus 10 are revealed. In the figure, the lower support assembly 12 is seen to include a lower support platform area represented in general at 182 and, preferably, structured robustly. In this regard, it may be formed, for example, of four C-channel members. The platform area 182 supports a motor 184 which may be, for example, of a 10 horsepower variety. The output of motor 184 at drive pulley 186 is transmitted to a pump pulley assembly 188 via belt arrangement 190. Pulley assembly 188 functions to drivably rotate pump shaft 192 of a stainless steel pump 194. Pump 194 is configured having two parallel inlets as well as two parallel outlets as described later herein in conjunction with FIG. 17. Pulley assembly 188 additionally drives a gear reduction assembly 204 through belt 206 and pulley 208. Assembly 204 functions to rotatably drive a main sprocket drive shaft 210. Drive also is imparted to a gear assembly 212 through pulley 214 and belt 216. Belt 216, in turn, is driven by a pulley (not shown) attached to pump shaft 192. Gear assembly 212 serves to rotate a head drive shaft 218 which extends to the upper portion 24 of chamber 22. Positioned at the top of lower support assembly 12 is a stainless steel fluid discharge ramp 220 which includes an upwardly disposed stainless steel fluid transfer surface 222. Note that the transfer surface 222 is canted or sloped at an angle of about 5° and extends continuously from a location beneath access deck assembly 32 to the outlet port 178. The slope of the ramp facilitates the removal of contaminant carrying fluids serving both to avoid cross-contamination of cleaner gloves with respect to contaminated gloves, and to minimize bacteria build-up due to the lowered dwell time of contaminated materials within the apparatus 10. Connections of components to the ramp 220 at surface 222 are, where appropriate, by sanitary welds to avoid the presence of pockets where bacteria may build-up. Additionally, the bearing blocks supporting drive shafts 210 and 218 are designed to avoid bacterial build-up and to assure that there is no egress of chlorine containing contaminated fluids into lower support assembly 12.

Figure 12:
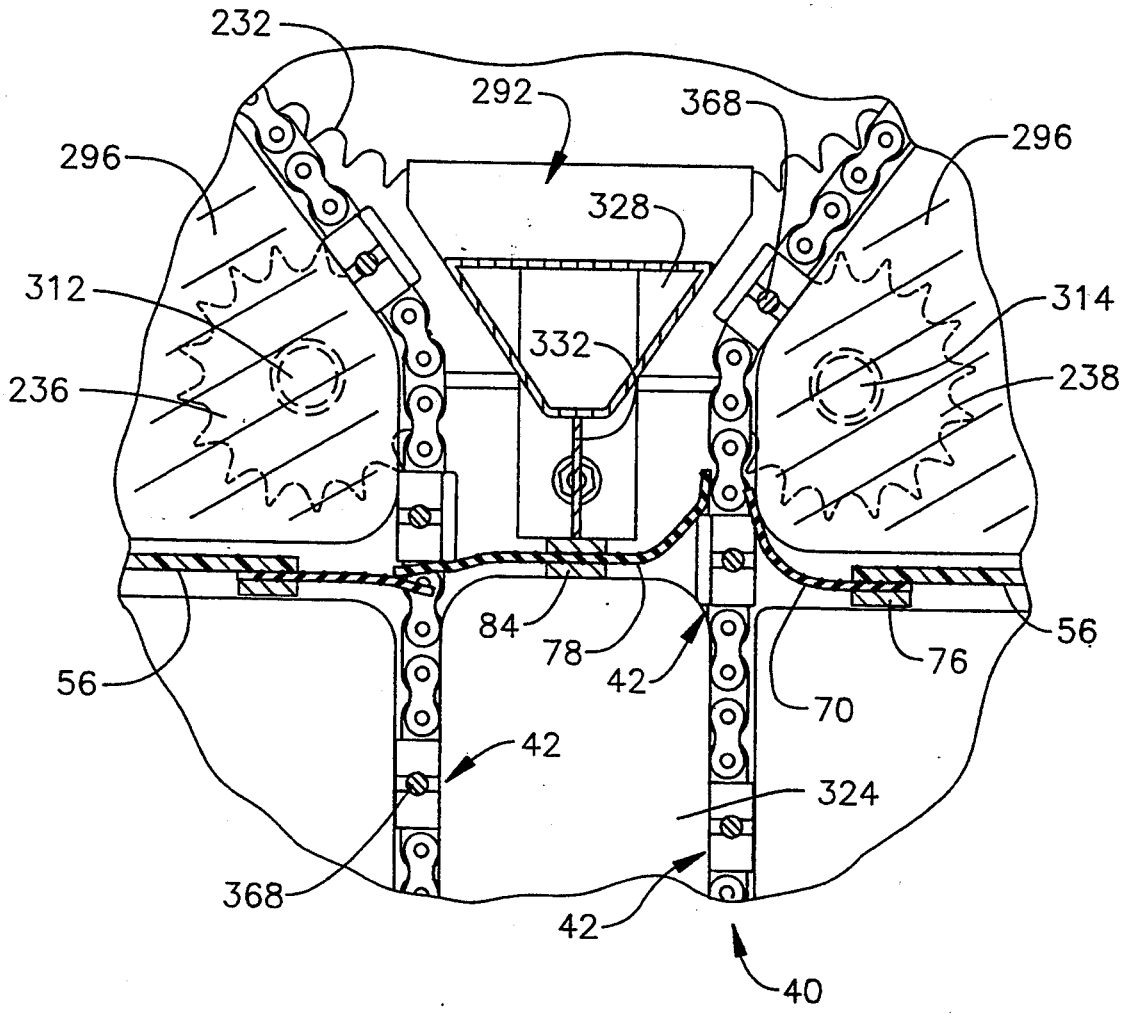
FIG. 12 is a partial sectional view taken through the plane 12—12 shown in FIG. 10.

Further supporting the aspect of avoidance of bacterial build-up, drive shaft 210 is seen to extend through an opening in discharge ramp 220. Shaft 210 is fixed, for example, by welding to the main sprocket 232 of conveyor assembly 40. Thus a two-piece composite structure is avoided. Shaft 210 is supported at ramp surface 222 by a bearing block 230 which is described in detail later herein. In general, conveyor assembly 40 includes an access or secondary stainless steel sprocket 234 and chain guiding stainless steel idler pulleys 236 and 238, one of which is shown in the instant figure and both of which are seen in FIG. 12. A tension adjustment assembly represented generally at 240 serves to adjust tension on the chain component of conveyor assembly 40 through sprocket 234. Assembly 240 is connected to a bracket which is welded to surface 222 of discharge ramp 220 in a manner facilitating fluid flow down the above-discussed slope thereof. In general, the main sprocket 232 provides drive to the conveyor assembly 40 to maneuver glove mounts 42 and associated gloves 44 into the containment chamber 22 about a generally circular conveyor locus. The glove mounts 42 are fed into this locus through the earlier-described entrance curtain assembly 66 and exit therefrom through the exit curtain assembly 68 (FIG. 3). Main sprocket 232 rotates about a main sprocket axis 242.

Positioned above the main sprocket 232 and glove mounts 42 as they are moved about the chamber locus of movement is a rotating spray head assembly represented generally at 250. Rotation is developed for assembly 250 from belt 216 and pulley 214 functioning to drive stainless steel head drive shaft 218 from gear assembly 212. Shaft 218 extends through a bearing block 252 mounted upon the fluid transfer surface 222 of ramp 220 in a manner similar to the mounting provided at beating block 230. Shaft 218 extends upwardly to be supported at a pillow block 254 and above which is drivably coupled two a pulley 256. Looking additionally to FIG. 7, it may be observed that pulley 256 is coupled in driving relationship with a belt 258 which, in turn, is coupled in driven relationship with a pulley 260. Pulley 260, in turn, drives the head manifold assembly 262 through a shaft seen in FIG. 8 at 264. The latter figure reveals that the head manifold assembly 262 performs in four quadrants, each having a principal stainless steel conduit 266–269. Coupled to each of the four principal quadrants are three stainless steel nozzles, such as nozzles 272–274 as seen in conjunction with principal conduit 267 in FIGS. 7 and 8. High pressure cleaning fluid as earlier described to be water at about 1,000 psi which is chlorinated and at a temperature of about 100° F., is expressed from these nozzles onto the gloves 44 in somewhat of a cascading fashion. In this regard, the nozzles within the quadrants are pointed at progressively lower and lower regions of the gloves 44 such that a form of downwardly sweeping cleaning action is developed. In this regard, note in FIG. 7 that nozzle 272 is at a lowest elevation, while nozzles 273 and 274 function to express highly pressurized cleaning fluid respectively below and at the fingertips of gloves 44. The figure further shows that such nozzles as at 276 and 277 are oriented and dimensioned to express fluid under pressure at progressively higher levels upon gloves 44. In general, the fingertips of gloves 44 will contain a larger amount of flesh or flesh contaminant. Thus, an enhanced form of cleaning action is employed. Looking particularly to FIG. 6, it may be observed that shaft 264 of the spray head assembly 250 rotates about a spray head axis 284. This rotation is in the opposite rotational sense as the conveyor locus rotation provided from main sprocket 232. However, the spray head assembly 250 is rotated about axis 284 at a greater rate of speed, e.g. 50 rpm. FIG. 6 reveals that the sprocket axis 242 is offset from spray head axis 284 by a small but optimal amount of about 0.25 inch. This 0.25 inch offset is provided to develop an undulating horizontal relative movement of the spray nozzles directed at the tip of gloves 44, for example, as provided at nozzles 273 and 274 described in connection with FIGS. 7 and 8. The undulating relative movement during the movement of the glove tip cleaning spray head nozzles improves cleaning action at the infested tips. To achieve adequate performance of the drive system for head assembly 250, it is desirable that pulleys 256 and 260 be formed of a temperature stable material able to withstand the 100° cleaning fluid temperature and which material also is required to be chemically stable in view of the chlorinated fluids utilized. It has been found that a polymer sold under the trade designation "Delrin" by E. I. DuPont de Nemours is suitable for this purpose. Belt 258 also encounters this severe environment. Preferably, the belt 258 is provided as a "Polycord" belt marketed by Habisit Belting, Inc., having a place of business at Schaumburg, Ill. Fluid transfer connection to the assembly 250 is from one of the two outlets of pump 194 and by flexible conduit to connection with the fluid pressure input to the stainless steel swivel assembly 286 of head assembly 250. Access to the upward portion of assembly 250 is through a bolted cover 288 located at the top surface of chamber 22.

Figure 7:
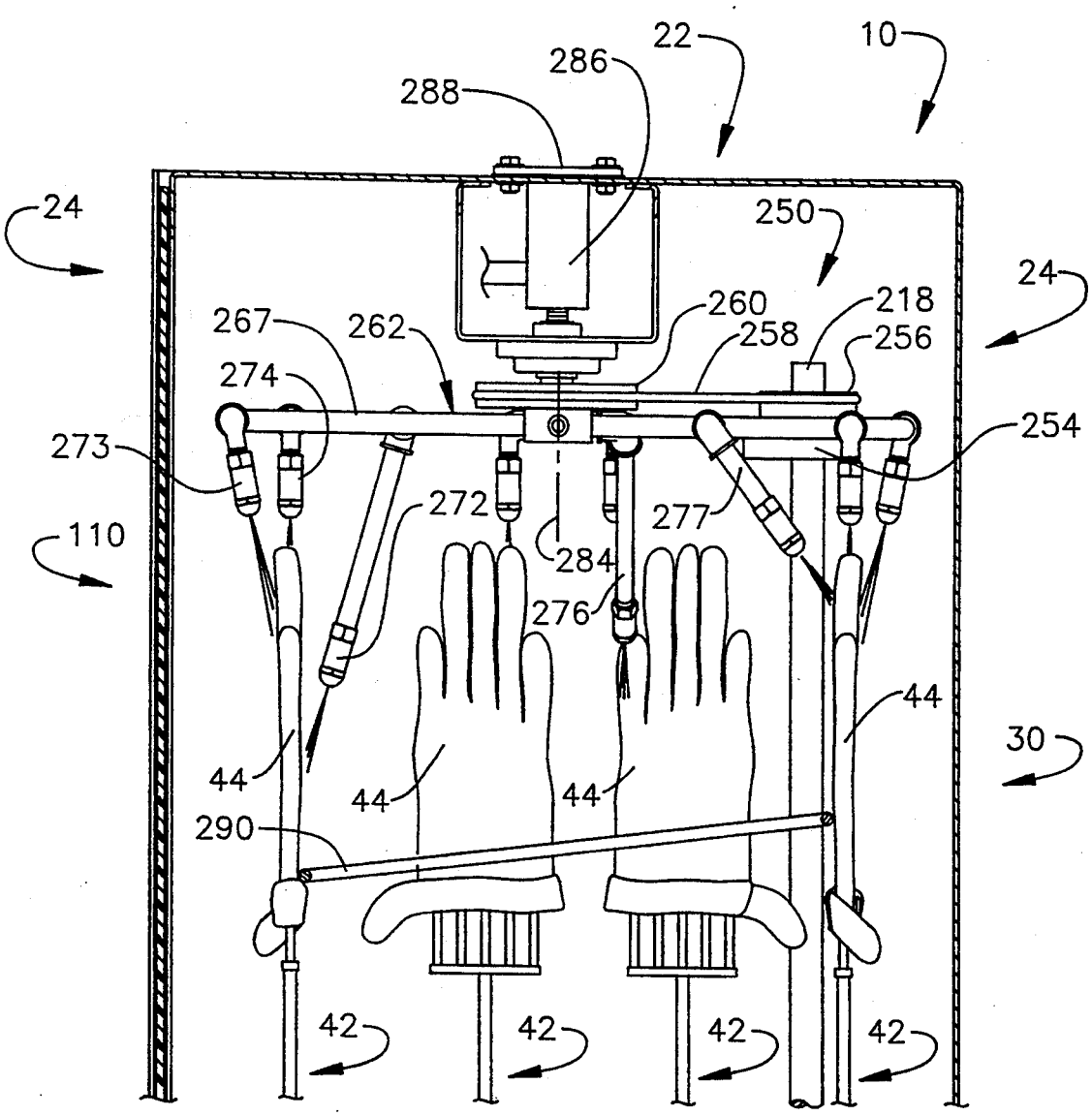
FIG. 7 is a partial sectional view taken through the plane 7—7 shown in FIG. 6.

In view of the nozzle positioning and undulating relative movement thereof during rotation, it is desirable that the glove mounts 42 remain vertically stable so as to consistently position gloves 44 for nozzle cleaning action. As part of this stability, an inner guide ring 290 is provided within chamber 22 against which the inward facing sides of mounts 42 may slidably abut during their travel along the chamber locus. Ring 290, in turn, is coupled in cantilever fashion with an upstanding stainless steel splash guard assembly represented generally at 292 by an attachment arrangement represented at 294, as is revealed in FIGS. 8 and 9. FIG. 7 particularly reveals that the ring 290 is canted from horizontal. This arrangement is provided to assure that the gloves 44 which it may contact are not shielded by it from cleaning activity. In this regard, should ring 290 be horizontal, an opportunity for such shielding is presented.

Figure 8:
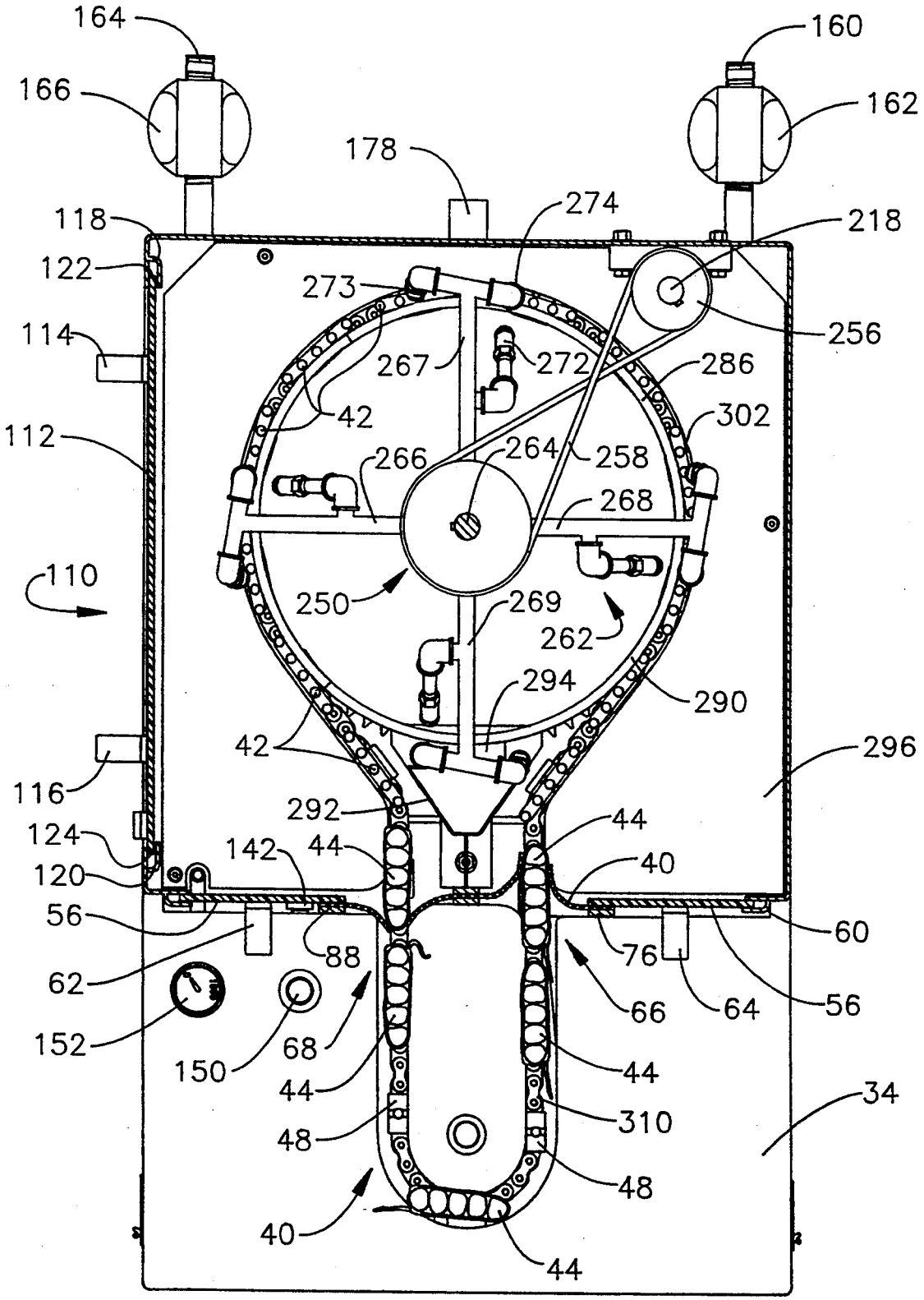
FIG. 8 is a sectional view taken through the plane 8—8 shown in FIG. 6.
Figure 9:
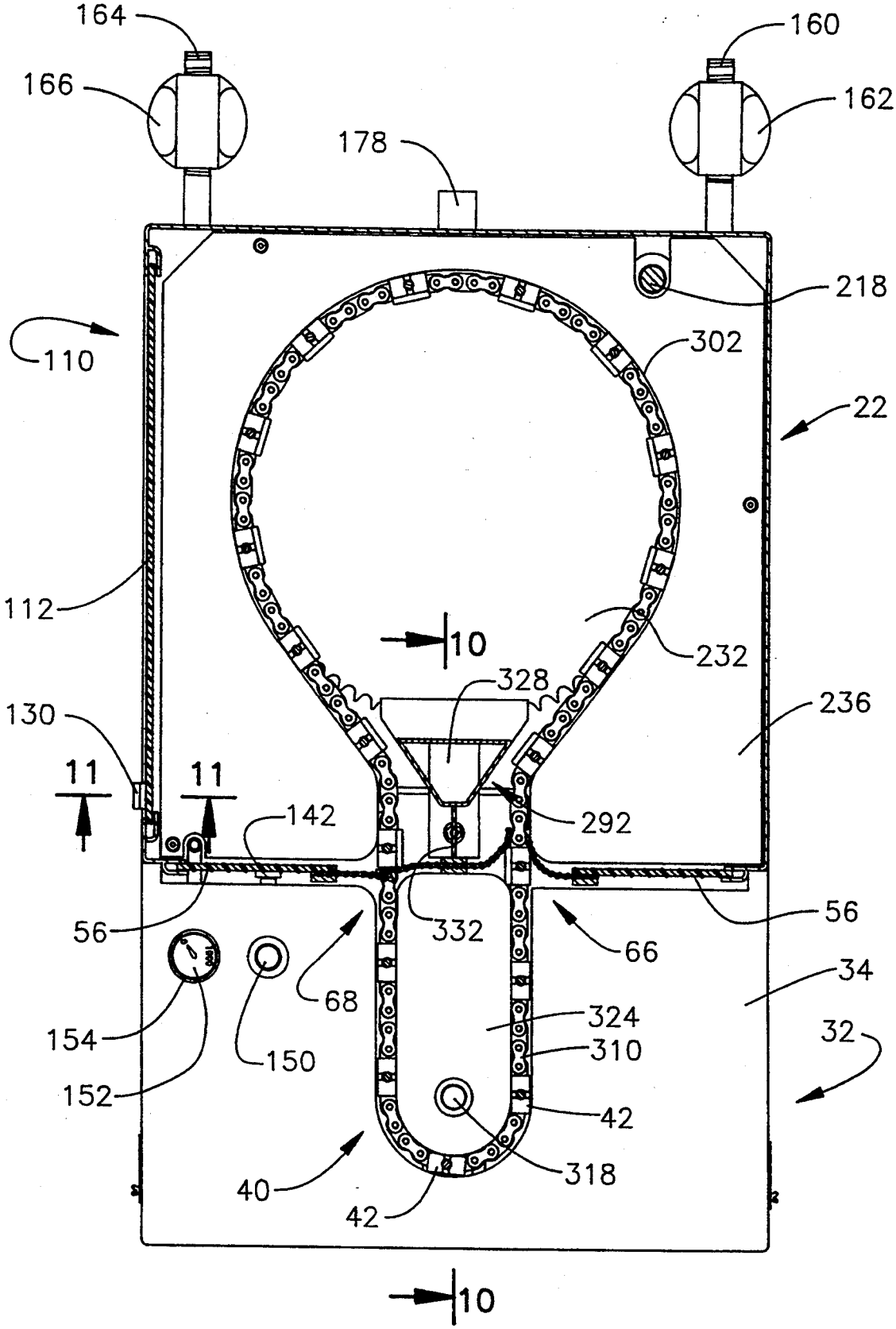
FIG. 9 is a sectional view taken through the plane 9—9 shown in FIG. 6.

Glove mounts 42 are provided with an outwardly disposed guide 296 at a lower elevation within chamber 22. Guide 296 is revealed in FIGS. 6, 8, and 9 as being formed of a polymeric sheet which is bolted to inwardly depending stainless steel brackets, two of which are shown at 298 and 300 in FIG. 6. FIGS. 8 and 9 show that the guide 296 is formed having a curved inner aperture, the periphery of which is shown at 302, against which the lower portions of glove mounts 42 slidably abut during the course of their movement along the chamber locus of movement.

Figure 10:
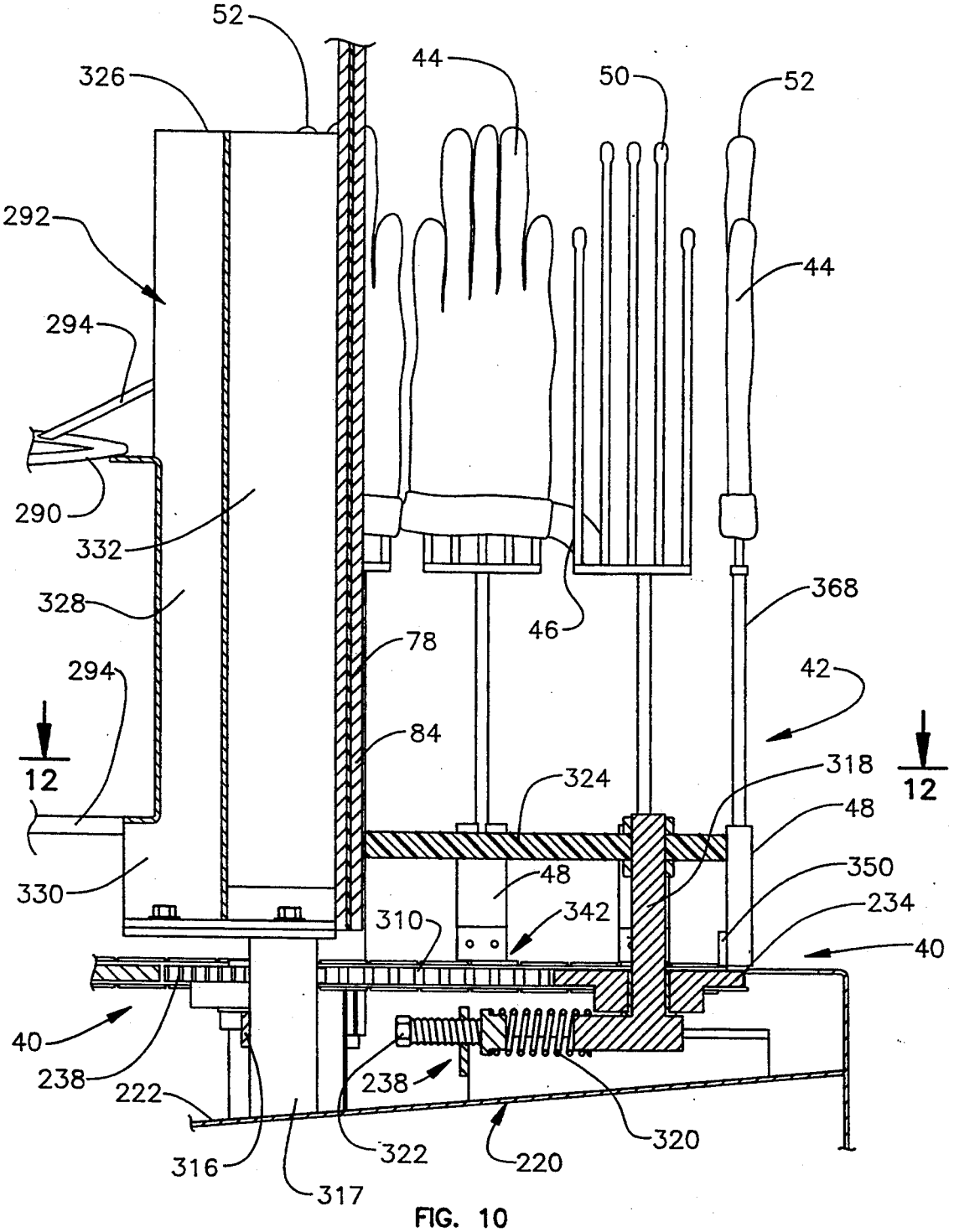
FIG. 10 is a partial sectional view taken through the plane 10—10 shown in FIG. 9.
Figure 13:
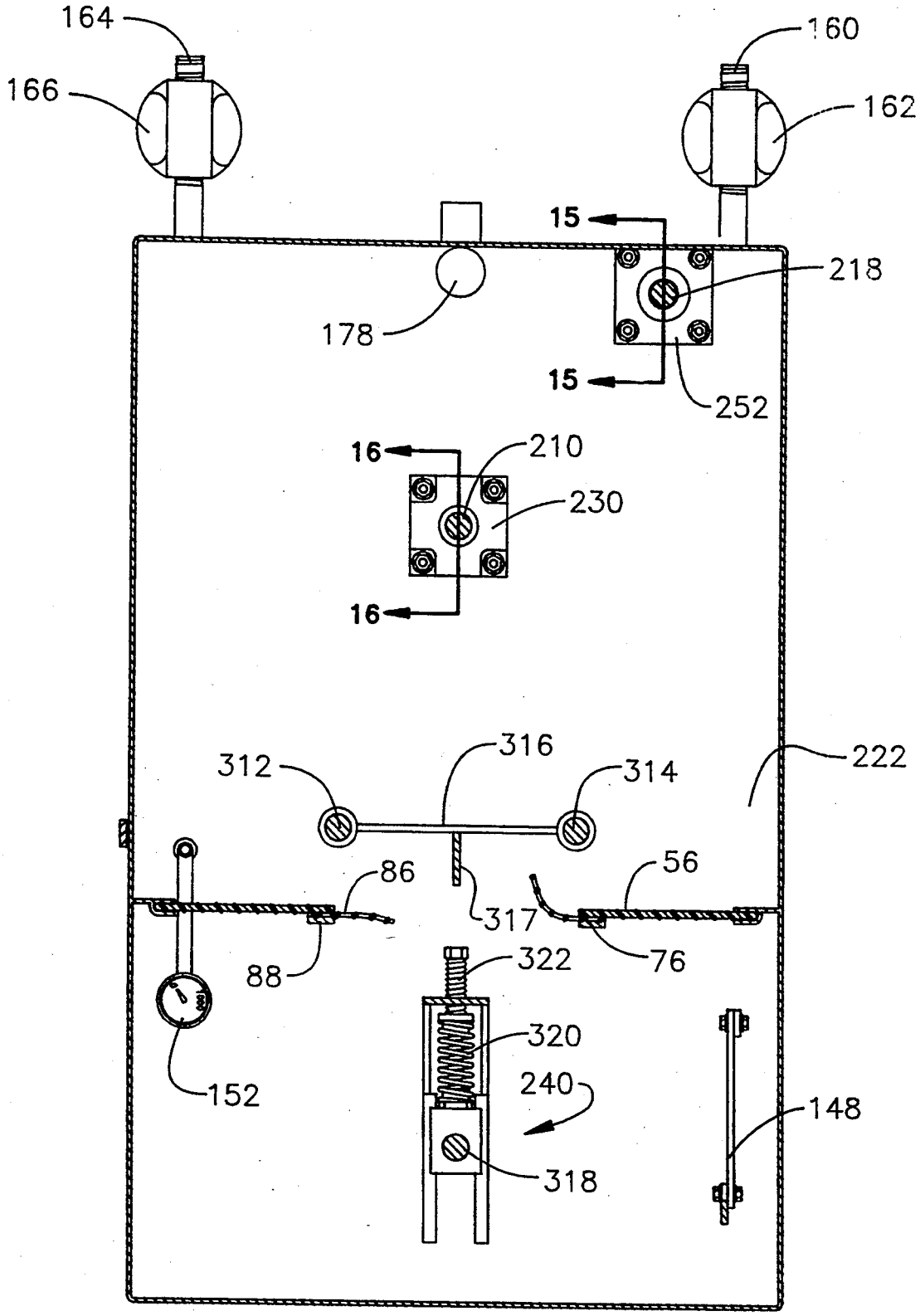
FIG. 13 is a sectional view taken through the plane 13—13 shown in FIG. 6.

Referring to FIGS. 9 and 10, conveyor assembly 40 and the locus of movement thereof is revealed in enhanced detail. In this regard, the assembly 40 is seen to be formed of a continuous stainless steel chain 310 which is positioned in driven relationship about main sprocket 232, and which extends through entrance opening 66 and exit opening 68 to be wound about secondary sprocket 234 seen in FIG. 10. To align chain 310 for movement through curtain assemblies 66 and 68, the earlier noted idler sprockets as are revealed in FIG. 12 at 236 and 238 are provided. These sprockets 236 and 238 respectively are mounted for free rotation upon stainless steel shafts seen in FIG. 12 at 312 and 314. As seen in FIG. 13, shafts 312 and 314, in rum, are mounted upon a stainless steel bracket or fixture 316 welded to fluid transfer surface 222 of ramp 220. Secondary sprocket 234 is mounted upon and supported by a stainless steel shaft 318 forming part of the tension adjustment assembly 238. Adjustment of tension is provided, as shown in FIG. 10, by the bias asserted against shaft 318 from stainless steel spring 320 in conjunction with the compression asserted thereto from a stainless steel bolt or machine screw 322. Note in FIG. 10 that shaft 318 extends upwardly from secondary sprocket 234 to rotate within and support an entrance guide 324 against which the inwardly disposed surfaces of lower mount components 48 abuttably slide. Guide 324 contributes to a necessary isolation of contaminated gloves entering chamber 22 through entrance curtain assembly 66 from the clean gloves emerging from chamber 22 through exit curtain assembly 68. The spacing developing this isolation should be at least about five inches.

With the arrangement shown, looking to FIG. 9, the conveyor locus of movement as established by chain 310 has an entrance region in conjunction with its movement along from sprocket 234 entrance guide 324, whereupon it extends into chamber 22 to establish a chamber region wherein contaminated gloves entering through entrance curtain assembly 66 are progressively cleaned of flesh and bacteria, whereupon the locus of movement extends through the chamber forward portion and exit curtain assembly 68 to sprocket 234. Within the latter region, personnel may remove the glove supporting fork-shaped glove supports 50 from the components 48 for removal of cleaned gloves 44. In general, the main sprocket is provided having about an 18 inch diameter and is driven at a rate of about 1½ rpm. Correspondingly, the nozzles at the spray head assembly 250 are rotated in the same direction at about 50 rpm. The cleaning or dwell time for the gloves while traveling along the chamber region of the locus of movement is about 62 seconds. The latter interval provides about a 99% reduction in bacteria plate count and is rapid enough to permit the cleaning of gloves during normal shift breaks.

FIGS. 8–10 and 12 additionally reveal detail of the splash guard assembly 292. Assembly 292 not only protects personnel standing adjacent access deck assembly 32 from high pressure spray at 100° F. in supplement with the curtain assemblies 66 and 68, but also assures an avoidance of cross contamination of gloves 44 at the entrance region of their locus of movement from clean gloves moving to the exit region. The assembly 292 is generally triangular in cross section and, as seen in FIG. 10, extends upwardly to a tip 326 located adjacent the tips 52 of gloves 44 as they move within chamber 22. This height is selected as an amount effective to block fluid sprayed over and splashing from gloves in the vicinity of the conveyor locus entrance region from contacting and cross contaminating gloves which are "clean" and exiting from the chamber 22. The assembly 292 is hollow in the region beneath guide ring 290 so as to provide a conduit 328 serving to guide fluids downwardly and then outwardly from a port 330 onto fluid transfer surface 222. Assembly 292 is bolted to bracket 317 which is welded to bracket 316 and surface 222, which, as noted above, is welded to fluid transfer surface 222 of ramp 220. FIGS. 10 and 12 further reveal the provision of a separation plate 332 which functions to assure the noted isolation of the entrance region from the exit region and, as seen in FIG. 6, the plate 332 further supports the stainless steel vertical mount for curtain 78 including stainless steel strap 84. With the arrangement shown, as cleaning shift personnel lift the door 56, polymeric sheets 78, 82, 90, and 92, being fixed to separation plate 332 by strap 84 remain in place for support during cleaning procedures.

Figure 14B:
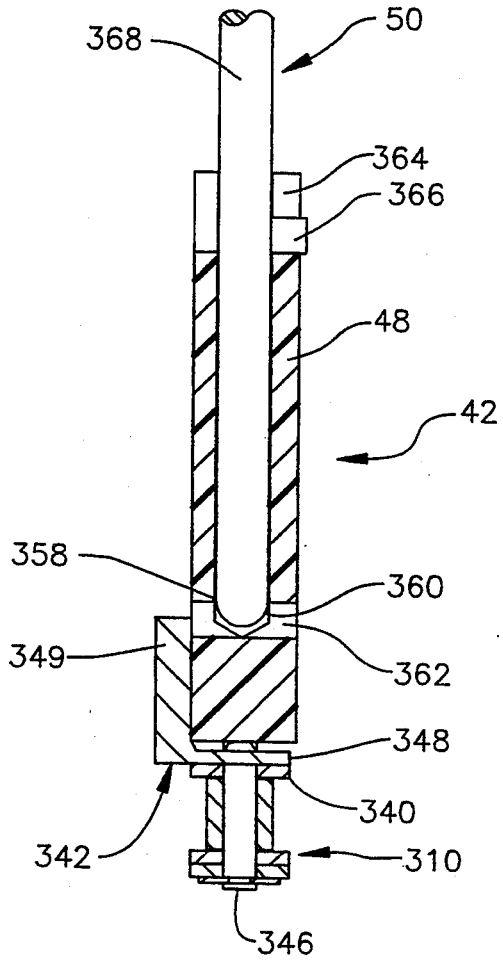
FIG. 14B is a sectional view taken through the plane 14B—14B shown in FIG. 14A.
Figure 14A:
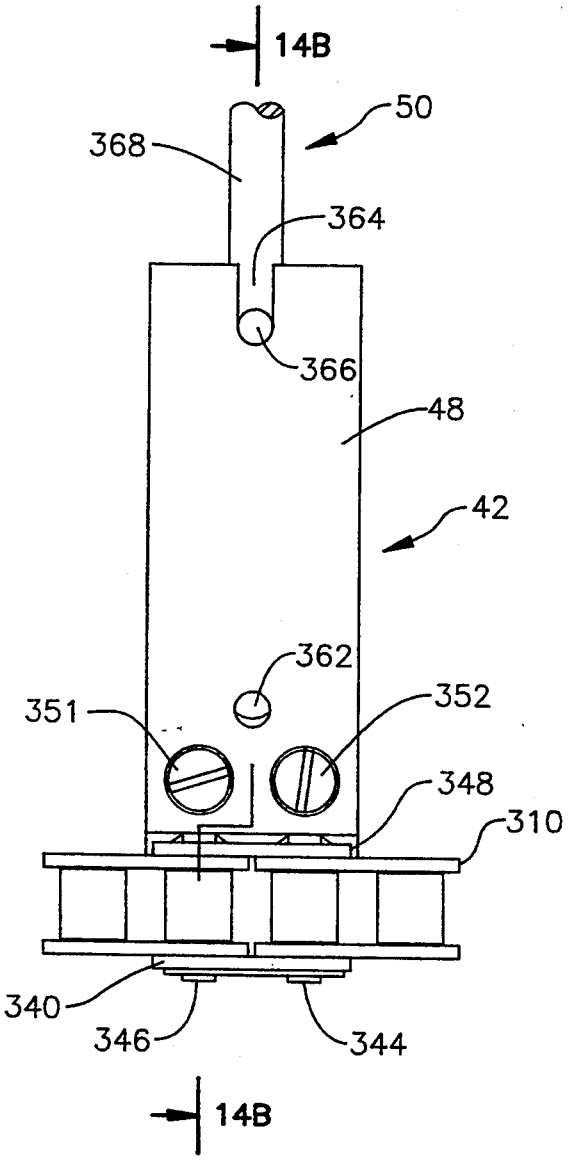
FIG. 14A is a plan view of a portion of a glove mount employed with the apparatus of the invention.

Referring to FIGS. 14A and 14B, the structure of the glove mounts represented generally at 42 as they are mounted upon chain 310 is revealed in enhanced detail. Because of the substantial height of the glove mount and necessity to avoid cross contamination of exit region containing clean gloves with respect to gloves entering chamber 22, the attachment of the mounts 42 to chain 310 must be structurally reliable. In FIG. 14A, a portion of chain 310 is reproduced with the same numeration. This chain 310 incorporates a master link 340 which as seen additionally in conjunction with FIG. 14B functions to support an L-shaped lower mount component 342. In this regard, the pins 344 and 346 utilized with master link 340 extend through and secure a horizontal flange 348 of mount component 342. Component 342 additionally includes an attachment flange 349 which will be aligned with the link 340 along the conveyor locus and which functions to vertically support rod support component 48. Attachment of the component 48 to flange 349 is by a stainless steel bolt arrangement including two bolts 351 and 352. Two bolts 351 and 352 are employed to assure the verticality of rod support component 48. It may be recalled that the glove mounts 42 are relatively high, exhibiting correspondingly heavy turning or pivoting moments at their connection with chain 310. FIG. 14B additionally reveals the presence of a vertical, cylindrical support cavity 358 which terminates at 360 and communicates with a fluid relief passage 362. Passage 362 facilitates the cleaning of cavity 358 as well as providing a drain for any fluids which may collect therein. The upwardly disposed portion of rod support component 48 is provided with a vertical alignment slot 364 which receives an alignment pin 366 fixed to and extending from the lower disposed rod 368 of fork-shaped glove support 50.

Figure 15:
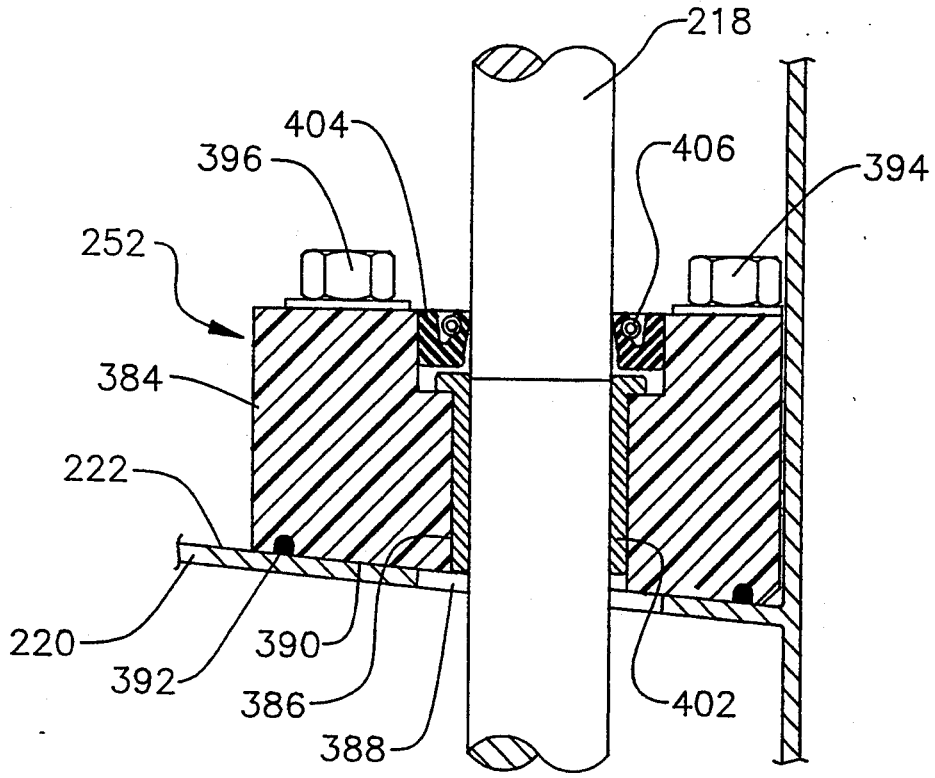
FIG. 15 is a partial sectional view taken through the plane 15—15 shown in FIG. 13.

The cleaning of equipment and floors of a meat processing facility is a physically taxing duty typically undertaken during late evening or early morning shifts. Accordingly, it is important that the equipment subject to cleaning such as apparatus 10 be constructed to avoid pockets leading to bacterial build-up and that such equipment be easily dismounted for purposes of cleaning. As indicated earlier herein, the front and side doors 56 and 112 of apparatus 10 readily are removed with a vertical lifting requirement of minimal extent. This exposes the entire chamber 22. As illustrated in connection with FIG. 5, the deck cover 34 of access deck assembly 32 is simply pivoted upwardly to provide access therebeneath. Next, as revealed in conjunction with FIG. 6, this procedure opens the entire fluid transfer surface 222 to easy access by cleaning personnel. In addition to being canted to promote contaminant containing fluid removal, the surface 222 supports only the minimal necessary components employed with apparatus 10. In this regard, FIG. 11 reveals that door 112 is supported above surface 222 by flange 380 such that the bottom of the door is not located within a collection, albeit temporal, of contaminant containing fluid. In similar fashion, door 56 is supported above surface 222, for example by a flange or protrudance 382 seen in FIG. 6. Bearning blocks 230 and 252, respectively supporting shafts 210 and 218 also are structured for the purpose of assuring that no chlorine containing fluids as well as contaminants may migrate into lower support assembly 12 and to minimize any opportunity for bacteria build-up. Looking to FIG. 15, bearing block 252 is revealed at an enhanced level of detail. Block 252 includes a polymeric housing 384 which is formed of a material having appropriate strength and which, additionally, is immune to the corrosive effects of chlorinated cleaning fluids and temperatures employed within chamber 22. A material suited for this purpose is marketed under the trade designation "Delrin" by E. I. DuPont de Nemours. The central portion of block 384 is bored at 386 and the block is centered over a circular opening 388 in deck assembly 220. To assure that no fluids may migrate into the opening 388, a circular groove of semi-circular cross-section is formed within the lower surface 390 of block 384 which receives polymeric O-ring 392. The entire assembly is retained in position by four bolts, two of which are seen at 394 and 396. O-rings 392 are positioned outwardly as far as practical from the opening 386 for the purpose of minimizing the extent of any region of possible bacterial capture.

A brass bushing 402 is positioned within opening 386 for receiving and rotatably supporting stainless steel shaft 218. Finally, polymeric seal 404 is located within the upper portion of opening 386 and is secured to the shaft 218 by stainless steel ting 406.

Figure 16:
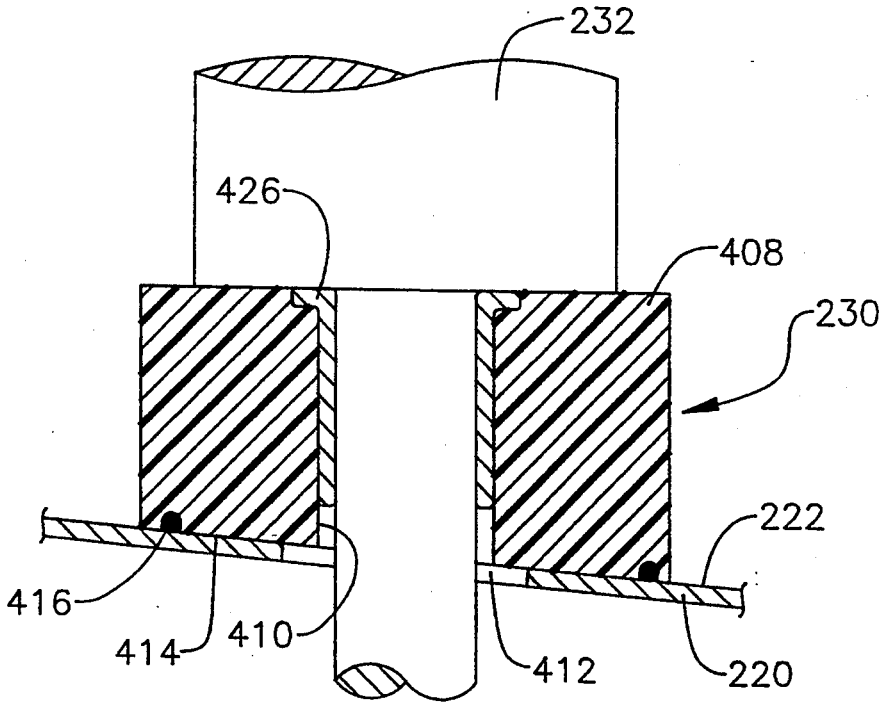
FIG. 16 is a partial sectional view taken through the plane 16—16 shown in FIG. 13.

Referring to FIG. 16, the corresponding mounting of beating block 230 upon ramp 220 is shown. Block 230 includes a polymeric housing 408 formed of the same material as housing 384. Housing 408 is configured having a centrally disposed bore 410 which is oriented over a circular opening 412 within ramp 220. The lower surface 414 of housing 408 is configured having a recess of semi-circular cross section functioning to receive a polymeric O-ring 416. Housing 408 and O-ring 416 are secured in position by four bolts, two of which are shown at 418 and 420. Rotatably supporting the drive shaft 210 is a brass bushing 426. Thus configured, the beating block 230 is immune to the corrosive effects of the environment of chamber 22 and, with the mounting thereof incorporating O-ring 416, the regions susceptible to bacteria build-up are minimized.

Figure 17:
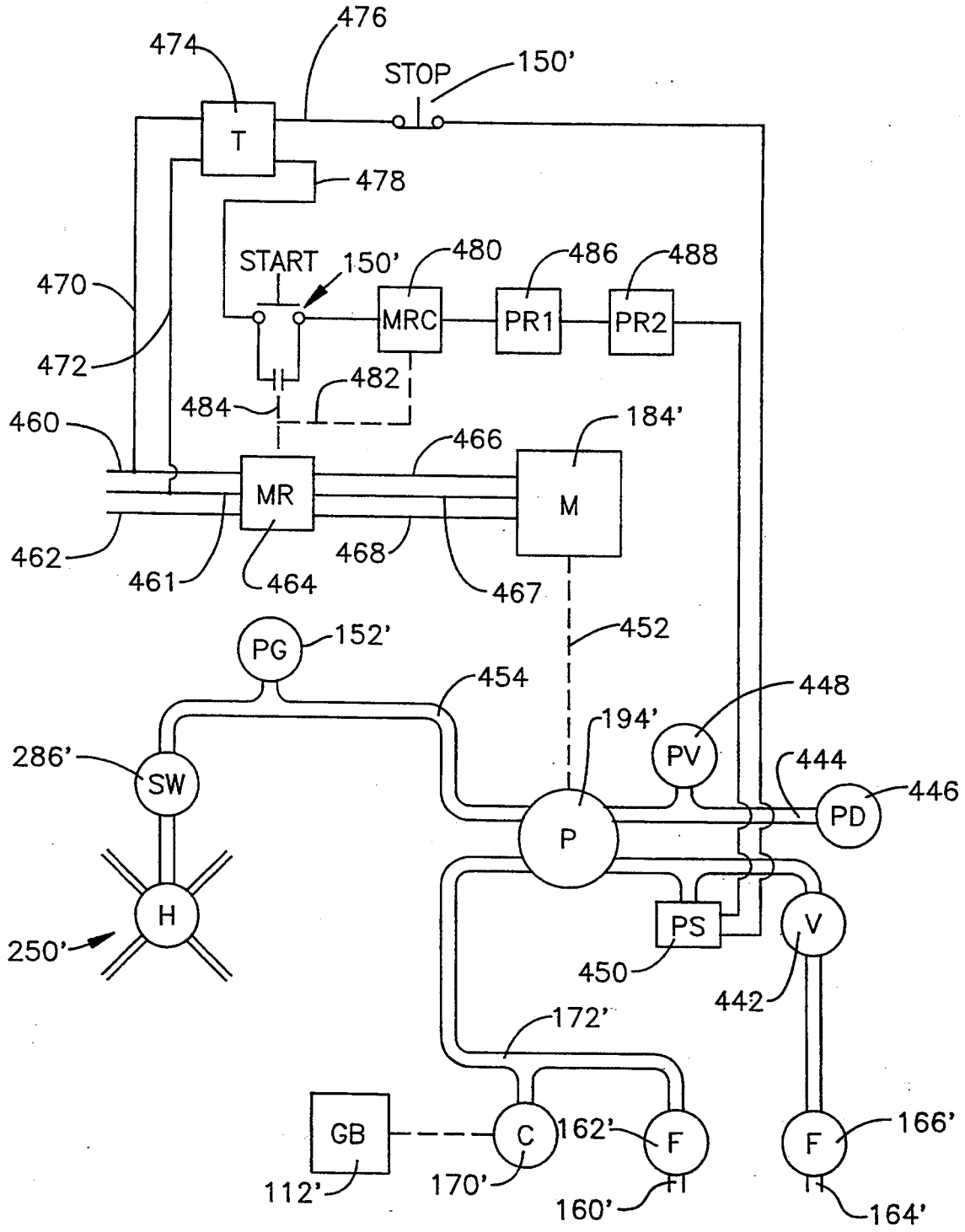
FIG. 17 is a schematic diagram showing fluid delivery and electrical circuitry employed with the apparatus of FIG. 1.

Referring to FIG. 17, a schematic representation of the drive, control, and fluid delivery components of apparatus 10 is revealed. Where appropriate, the same numeration employed in earlier figures is utilized in the schematic diagram but in primed fashion. In the figure, hot water is seen introduced at port 160' whereupon it is filtered at filter 162' and directed via conduit 440 through a heat adjustment valve 442 to one input of pump 194'. The stainless steel pump 194' is of a two input, two output variety. The pump may be provided, for example, as a Model 1050 pump marketed by cat Pumps U.S.A., Inc. of Minneapolis, Minn. One output of pump 194' is coupled as represented by conduit 444 with a pressure damper or accumulator 446. While such devices typically are not employed with the pumping arrangement shown, it has been found that the utilization of such an accumulator or damper 446 improves the performance of pump 194'. Additionally, communicating with conduit 444 is a pressure valve or blow-off valve 448.

The cold water input to the apparatus is represented at 164' which is directed to the input of filter 166'. Filtered cold water is directed, as represented at conduit 168', to a chlorinator 170'. Preferably, chlorinator 170' adds chlorine with a positive pressure addition to an extent that the resultant cleaning fluid, following hot and cold water mixture at pump 194', will exhibit a chlorine content of between about 150 and 200 parts per million (ppm). Within this range, a chlorine content of 180 ppm is preferred. Fluid having been chlorinated, then is passed via conduit 172' to an opposite input to pump 194'. A pressure switch 450 is provided in fluid communication with hot water conduit 164' and has a normally closed orientation. Upon the occurrence of an excessive pressure at conduit 164', switch 450 will open.

Pump 194' is driven from motor 184' as represented by dashed association line 452. The opposite output of pump 194' is represented at conduit 454 which is directed to a swivel connector 286' associated with head assembly 250'. Pressure gauge 152' is seen coupled with conduit 454.

With the arrangement shown, the cleaning fluid directed to head 250' is at an optimum temperature value of about 100° F. Additionally, the fluid will be chlorinated to an optimum value of 180 ppm, and the fluid is expressed from the head assembly 250' at about 1000 psi. This combination has been found to optimally reduce glove plate counts as well as drive flesh contaminants from the gloves. An additional advantage accrues from the utilization of both hot and cold water for the system inasmuch as the supplies of water available in typical processing plants are limited because of the high demands of the overall processes involved. By utilizing both the hot and cold water supplies of the plant in parallel, assurance is made that adequate water volume or flow is available for the pump 194' of apparatus 10. No pump starvation is encountered. Additionally, the positive pressure input from chlorinator 170' promotes improved pressures.

Motor 184' generally will have a rating of about 10 hp. The motor is coupled to three phase high voltage inputs as represented at lines 460–462. Lines 460–462 are seen directed to a motor relay 464 which carries out start and stop functions. From relay 464, a three phase input is provided to motor 184' from lines 466–468. Phase line 460 and neutral line 461 are tapped by respective lines 470 and 472 and the voltages associated therewith are reduced at a step-down transformer 474. The lower control voltage levels are provided from transformer 474 at lines 476 and 478. Line 478 extends through a normally open start switch 150' which, when momentarily closed, serves to close a motor relay control 480. When actuated, motor relay control 480 effects the closure of motor relay 464 as represented by dashed lines 482 and 484. Line 478 as well as associated line 476 may be open circuited by a stop switch 150' which is incorporated mechanically with the start function thereof as well as by pressure switch 450 and proximity switches 486 and 488. Switch 486 may, for example, carry out the function of position locator component 130 as it is associated with proximity device 133 (FIG. 11), while switch 488 represents the function carried out in conjunction with proximity device 144 as associated with position locator component 142 (FIG. 5).

Since certain changes may be made in the above-described system and apparatus without departing from the scope of the invention herein involved, it is intended that all matter contained in the description thereof or shown in the accompanying drawings shall be interpreted as illustrative and not in a limiting sense.

I claim:

1. Apparatus for removing flesh containing contaminants from protective gloves of a variety having a forward tip region and a wrist securement component of given length, comprising:

a containment chamber having an upper portion, a forward portion, a side portion and a lower disposed portion;

an access deck assembly mounted adjacent said containment chamber forward portion and communicating with said lower disposed portion;

a lower support assembly connected in supporting relationship with said containment chamber at said lower disposed portion;

a conveyor assembly including a main sprocket of first diameter mounted for rotation about its central axis within said containment chamber lower portion, a second sprocket of second diameter less than said first diameter mounted for rotation upon said access deck assembly, and a link containing conveyor chain extending about a portion of said main sprocket, through said containment chamber forward portion, and about a portion of said second sprocket, said conveyor chain defining a conveyor locus of movement having an entrance region between said second sprocket and said chamber forward portion, a chamber region extending about said portion of said main sprocket, and an exit region extending from said chamber forward portion to said second sprocket, said exit region being horizontally spaced apart a predetermined distance from said entrance region;

a plurality of said spaced apart vertically upstanding glove mounts coupled to said conveyor chain, movable therewith about said conveyor locus, configured for vertically receiving and supporting said forward tip region of said gloves at a distance above said conveyor chain effective to avoid the entanglement of said securement component with said conveyor chain;

a spray head assembly having a spray head axis and mounted within said containment chamber at said upper portion and connected with a source of fluid under pressure for spraying said fluid over said gloves supported by said glove mounts when within said chamber;

an outlet port mounted within said containment chamber below said conveyor assembly and extending in fluid transfer relationship outwardly from said chamber for removing contaminant carrying fluid therefrom;

a fluid discharge ramp mounted within said containment chamber below said conveyor assembly, configured for capturing all said contaminant carrying fluid and having a fluid transfer surface extending downwardly at a predetermined slope to said outlet port;

an entrance curtain assembly located at said chamber forward portion and positioned about said conveyor chain at said entrance region;

an exit curtain assembly located at said chamber forward portion and positioned about said conveyor chain at said exit region; and a splash guard assembly of predetermined length positioned within said chamber intermediate said entrance and exit curtains.

2. The apparatus of claim 1 in which said glove mounts are configured for supporting said tip region of said gloves a said distance of about 25 inches above said conveyor chain.

3. The apparatus of claim 1 in which said glove mounts are configured having a lower mount component fixed to a said link of said conveyor chain, each having an upstanding attachment flange aligned with said link along said conveyor locus; an upstanding rod support component connected with said attachment flange, having a centrally disposed elongate and vertically oriented support cavity extending from a top surface to a lower terminus and a fluid relief passage extending therethrough at said cavity lower terminus; and a fork-shaped glove support having a lower disposed rod removably receivable within said support cavity.

4. The apparatus of claim 1 in which said predetermined slope of said discharge ramp fluid transfer surface is about 5 degrees.

5. The apparatus of claim 1 in which said discharge ramp extends within said access deck assembly below said conveyor assembly.

6. The apparatus of claim 1 in which said splash guard assembly predetermined height extends upwardly an amount effective to block said fluid sprayed over and splashing from said gloves supported by said glove mounts in the vicinity of said conveyor locus entrance region from contacting and thereby cross-contaminating gloves supported by said glove mounts in the vicinity of said conveyor locus exit region.

7. The apparatus of claim 6 in which said splash guard is configured having a vertical, internally disposed conduit extending from said upper portion adjacent said gloves mounted upon said glove mount to said chamber lower portion above said fluid discharge ramp.

8. The apparatus of claim 1 in which said entrance curtain assembly comprises:

first and second mutually inwardly facing flexible polymeric sheets having mutually outwardly disposed vertical sides mounted at said chamber forward portion, said first sheet having mutually inwardly disposed vertical sides with an overlap of first horizontal extent, having a height extending from a bottom location adjacent said conveyor assembly to a top location adjacent to and spaced below a said glove when supported upon a said glove mount, said second sheet having a height extending from said bottom location to an upper location located above said glove mounts; and third inwardly facing flexible polymeric sheet having an outwardly disposed vertical side mounted at said forward portion having mutually inwardly disposed vertical side overlapping said second sheet inwardly disposed vertical side a second horizontal extent, having a height extending from a lower location adjacent said top location of said first sheet to said upper location.

9. The apparatus of claim 8 in which said overlap first horizontal extent is about one inch, and said second horizontal extent is less than about three-eighths inch.

10. The apparatus of claim 8 in which the thickness of said first, second and third polymeric sheets is about 0.06 inch.

11. The apparatus of claim 1 in which said exit curtain assembly comprises:

first and second mutually inwardly facing flexible polymeric sheets having mutually outwardly disposed vertical sides mounted at said chamber forward portion, having mutually inwardly disposed vertical sides with an overlap of less than about three-eighths inch extending from a lower location adjacent to and spaced below a said glove when supported upon said glove mount to an upper location located above said glove mounts.

12. The apparatus of claim 1 in which said exit curtain assembly comprises:

first and second mutually inwardly facing flexible polymeric sheets having a thickness of about 0.06 inch, having mutually outwardly disposed vertical sides mounted at said chamber forward portion, having mutually inwardly disposed vertical sides with an overlap of about one inch extending from a bottom location adjacent said conveyor assembly to a top location adjacent to and spaced below a said glove when supported upon a said glove mount.

13. The apparatus of claim 1 in which:

said spray head assembly includes at least two substantially vertically downwardly directed spray nozzles rotatable about said spray head axis at radial locations directing said fluid upon said tip region of each of said gloves when mounted upon said glove mounts during movement thereof along said chamber region of said conveyor locus; and said central axis of said main sprocket is offset from said spray head axis about 0.25 inch to derive altering relative position of said downwardly directed spray nozzles over said forward tip region of each said glove.

14. The apparatus of claim 1 in which:

said lower support assembly includes a drive system with a vertical drive shaft extending through a shaft opening within said fluid discharge ramp to rotational driving connection with said conveyor assembly main sprocket;

a beating block within said chamber supporting said drive shaft for rotation, having a block lower surface surmounting said shaft opening and abuttably connected against said fluid discharge ramp fluid transfer surface; and an annular fluid seal positioned intermediate said block lower surface and said fluid transfer surface.

* * * * *